US006096169A

United States Patent [19]

Hermans et al.

[11] Patent Number: 6,096,169

[45] Date of Patent: Aug. 1, 2000

[54] METHOD FOR MAKING CELLULOSIC WEB WITH REDUCED ENERGY INPUT

[75] Inventors: Michael Alan Hermans, Neenah; Sherry Lynn Behnke, North Fond du Lac; Robert Irving Gusky; Frank Stephen Hada, both of Appleton, all of Wis.

[73] Assignee: Kimberly-Clark Worldwide, Inc., Neenah, Wis.

[21] Appl. No.: 08/961,916

[22] Filed: Oct. 31, 1997

Related U.S. Application Data

[63] Continuation-in-part of application No. 08/647,508, May 14, 1996, abandoned.

[51] Int. Cl.[7] ..... D21F 1/48

[52] U.S. Cl. ..... 162/115; 162/207; 162/208

[58] Field of Search ..... 162/111, 115, 162/205, 207, 208, 297

[56] References Cited

U.S. PATENT DOCUMENTS

| | | | |
|---|---|---|---|
| 1,297,192 | 3/1919 | Le Roy et al. . | |
| 1,718,573 | 6/1929 | Millspaugh . | |
| 2,091,805 | 8/1937 | Chuse | 92/38 |
| 2,861,354 | 11/1958 | Hultgreen | 34/68 |
| 2,926,116 | 2/1960 | Keim | 162/164 |

(List continued on next page.)

FOREIGN PATENT DOCUMENTS

| | | |
|---|---|---|
| 677 083 | 12/1963 | Canada . |
| 0 033 559 A2 | 8/1981 | European Pat. Off. . |
| 0 328 227 A2 | 8/1989 | European Pat. Off. . |
| 0 502 602 A1 | 9/1992 | European Pat. Off. . |
| 0 574 366 A1 | 12/1993 | European Pat. Off. . |
| 0 616 074 A1 | 9/1994 | European Pat. Off. . |
| 679 469 | 4/1930 | France . |
| 1235868 | 5/1960 | France . |
| 2 303 116 | 10/1976 | France . |
| 1057373 | 2/1967 | United Kingdom . |
| 2 152 961 | 8/1985 | United Kingdom . |
| 2 179 949 | 3/1987 | United Kingdom . |
| 2 179 953 | 3/1987 | United Kingdom . |

(List continued on next page.)

OTHER PUBLICATIONS

Bieman, Leonard H., Kevin G. Harding, and Albert Boehnlein, "Absolute Measurement Using Field Shifted Moiré ," *Optics, Illumination, and Image Sensing for Machine Vision VI,* SPIE Proceedings Series, Nov. 14–15, 1991, vol. 1614, pp. 259–264.

Bowden, Edward V., "Non–Contact Drying and Turning—the 'On Machine' Technology of the Nineties," *Appita,* vol. 44, No. 1, Jan. 1991, pp. 41–46.

Haberl, Andrew et al., "First Linerboard Application Of The Gas Heated Paper Dryer," *45th Appita Annual General Conference Proceedings,* vol. 1, 1991, pp. 47–50.

(List continued on next page.)

*Primary Examiner*—Dean T. Nguyen

*Attorney, Agent, or Firm*—Patricia A. Charlier; Thomas M. Gage

[57] ABSTRACT

A noncompressive dewatering device generates air streams that can be used to remove water from cellulosic webs in an energy efficient manner. Further, a wet-pressed machine can be modified to economically produce low-density tissue with an energy/capital efficiency greater than that of the throughdrying process. For instance, a cellulosic web can be non-compressively dewatered from a post forming consistency to a consistency from about 25 percent to the water retention consistency by passing air through the web with an Energy Efficiency at least 10 percent greater than that achievable using vacuum dewatering at the same speed. In particular embodiments, the web may be non-compressively dewatering to a consistency of at least 70 percent of the water retention consistency using about 13 or less horsepower per inch of sheet width, or to a consistency of at least 80 percent of the water retention consistency using about 30 or less horsepower per inch of sheet width, both at a speed of 2500 feet per minute or greater.

25 Claims, 14 Drawing Sheets

U.S. PATENT DOCUMENTS

| | | | |
|---|---|---|---|
| 3,052,991 | 9/1962 | Goldner | 34/89 |
| 3,058,873 | 10/1962 | Keim et al. | 162/164 |
| 3,176,412 | 4/1965 | Gardner | 34/122 |
| 3,208,158 | 9/1965 | Smith, Jr. | 34/122 |
| 3,220,914 | 11/1965 | Boadway et al. | 161/128 |
| 3,224,926 | 12/1965 | Bernardin | 162/146 |
| 3,284,285 | 11/1966 | Holden | 162/297 |
| 3,303,576 | 2/1967 | Sisson | 34/115 |
| 3,319,354 | 5/1967 | Hering, Jr. et al. | 34/155 |
| 3,340,617 | 9/1967 | Carroll, Jr. | 34/18 |
| 3,371,427 | 3/1968 | Thygeson, Sr. | 34/155 |
| 3,447,247 | 6/1969 | Daane | 34/122 |
| 3,455,778 | 7/1969 | Bernardin | 162/113 |
| 3,537,954 | 11/1970 | Justus | 162/305 |
| 3,574,261 | 4/1971 | Bailey | 34/23 |
| 3,577,651 | 5/1971 | Nichols | 34/155 |
| 3,587,177 | 6/1971 | Overly et al. | 34/156 |
| 3,599,341 | 8/1971 | Darcy et al. | 34/23 |
| 3,617,442 | 11/1971 | Hurschman | 162/212 |
| 3,629,056 | 12/1971 | Forrest | 162/305 |
| 3,729,376 | 4/1973 | Stevens | 162/306 |
| 3,771,236 | 11/1973 | Candor et al. | 34/16 |
| 3,771,239 | 11/1973 | Minoda et al. | 34/156 |
| 3,810,818 | 5/1974 | Arledter | 162/301 |
| 3,812,598 | 5/1974 | Lefebvre et al. | 34/155 |
| 3,822,182 | 7/1974 | Heyse et al. | 162/207 |
| 3,844,881 | 10/1974 | Moody | 162/297 |
| 3,849,904 | 11/1974 | Villalobos | 34/155 |
| 3,895,449 | 7/1975 | Chance et al. | 34/155 |
| 3,913,241 | 10/1975 | Chaikin et al. | 34/122 |
| 3,923,593 | 12/1975 | Verseput | 162/301 |
| 3,930,319 | 1/1976 | Coleman | 34/122 |
| 4,072,557 | 2/1978 | Schiel | 162/111 |
| 4,074,441 | 2/1978 | Helversen et al. | 34/122 |
| 4,120,747 | 10/1978 | Sarge, III et al. | 162/117 |
| 4,121,968 | 10/1978 | Wells | 162/290 |
| 4,125,430 | 11/1978 | Grossman | 162/207 |
| 4,157,938 | 6/1979 | Clemens et al. | 162/207 |
| 4,163,688 | 8/1979 | Kankaanpaa | 162/359 |
| 4,183,147 | 1/1980 | Kawaguchi | 34/16 |
| 4,197,973 | 4/1980 | Daane | 226/97 |
| 4,201,323 | 5/1980 | Stibbe et al. | 226/97 |
| 4,309,246 | 1/1982 | Hulit et al. | 162/113 |
| 4,345,385 | 8/1982 | Sando et al. | 34/23 |
| 4,361,466 | 11/1982 | Wong et al. | 162/207 |
| 4,364,185 | 12/1982 | Dussourd et al. | 34/122 |
| 4,421,600 | 12/1983 | Hostetler | 162/111 |
| 4,440,597 | 4/1984 | Wells et al. | 162/111 |
| 4,462,868 | 7/1984 | Oubridge et al. | 162/280 |
| 4,528,316 | 7/1985 | Soerens | 524/503 |
| 4,529,480 | 7/1985 | Trokhan | 162/109 |
| 4,541,895 | 9/1985 | Albert | 162/348 |
| 4,551,199 | 11/1985 | Weldon | 162/109 |
| 4,556,450 | 12/1985 | Chuang et al. | 162/204 |
| 4,571,359 | 2/1986 | Dutt | 428/240 |
| 4,637,859 | 1/1987 | Trokhan | 162/109 |
| 4,835,880 | 6/1989 | Vecchia | 34/115 |
| 4,849,054 | 7/1989 | Klowak | 162/109 |
| 4,871,425 | 10/1989 | Gunderson | 162/290 |
| 4,888,096 | 12/1989 | Cowan et al. | 162/358 |
| 4,892,622 | 1/1990 | Malkki et al. | 162/208 |
| 4,915,788 | 4/1990 | Winheim | 162/207 |
| 4,953,297 | 9/1990 | Eskelinen et al. | 34/23 |
| 4,976,821 | 12/1990 | Laapotti | 162/360.1 |
| 4,986,009 | 1/1991 | Haessner et al. | 34/23 |
| 5,043,046 | 8/1991 | Laapotti | 162/358 |
| 5,048,589 | 9/1991 | Cook et al. | 162/109 |
| 5,070,627 | 12/1991 | Zagar | 34/156 |
| 5,070,628 | 12/1991 | Zagar | 34/156 |
| 5,085,737 | 2/1992 | Brogyanyi et al. | 162/359 |
| 5,105,562 | 4/1992 | Hella et al. | 34/156 |
| 5,129,988 | 7/1992 | Farrington, Jr. | 162/123 |
| 5,137,600 | 8/1992 | Barnes et al. | 162/115 |
| 5,149,401 | 9/1992 | Langevin et al. | 162/207 |
| 5,187,219 | 2/1993 | Furman, Jr. | 524/377 |
| 5,225,042 | 7/1993 | Eaton et al. | 162/300 |
| 5,230,776 | 7/1993 | Andersson et al. | 162/290 |
| 5,274,930 | 1/1994 | Ensign et al. | 34/23 |
| 5,336,373 | 8/1994 | Scattolino et al. | 162/116 |
| 5,348,620 | 9/1994 | Hermans et al. | 162/9 |
| 5,381,580 | 1/1995 | Kotitschke et al. | 15/302 |
| 5,411,636 | 5/1995 | Hermans et al. | 162/109 |
| 5,429,686 | 7/1995 | Chiu et al. | 139/383 A |
| 5,490,903 | 2/1996 | Chen et al. | 162/111 |
| 5,501,768 | 3/1996 | Hermans et al. | 162/9 |
| 5,508,095 | 4/1996 | Allum et al. | 428/242 |
| 5,556,053 | 9/1996 | Henseler | 242/541.6 |
| 5,598,643 | 2/1997 | Chuang et al. | 34/406 |
| 5,601,871 | 2/1997 | Krzysik et al. | 427/288 |
| 5,607,551 | 3/1997 | Farrington, Jr. et al. | 162/109 |
| 5,611,893 | 3/1997 | Pajula et al. | 162/360.2 |
| 5,620,566 | 4/1997 | Holopainen | 162/205 |
| 5,625,961 | 5/1997 | Ensign et al. | 34/117 |
| 5,656,132 | 8/1997 | Farrington, Jr. et al. | 162/117 |
| 5,667,636 | 9/1997 | Engel et al. | 162/117 |

FOREIGN PATENT DOCUMENTS

| | | |
|---|---|---|
| 2 235 754 | 3/1991 | United Kingdom . |
| 2 254 288 | 10/1992 | United Kingdom . |
| WO 90/04676 A1 | 5/1990 | WIPO . |
| WO 91/16493 A1 | 10/1991 | WIPO . |
| WO 93/23616 A1 | 11/1993 | WIPO . |
| WO 95/00706 A1 | 1/1995 | WIPO . |
| WO 97/43483 A1 | 11/1997 | WIPO . |
| WO 97/43484 A1 | 11/1997 | WIPO . |

OTHER PUBLICATIONS

Kufferath, W. et al., "Die Sonic–Roll," *Das Papier,* 42(10A): V140, 1988.

Lindsay, Jeffrey D. and Leonard H. Bieman, "Exploring Tactile Properties of Tissue With Moire Interferometry," *Non–Contact, Three–Dimensional Gaging Methods and Technologies Workshop,* Dearborn, Michigan, Mar. 1997.

Lindsay, Jeffrey D., "Displacement Dewatering To Maintain Bulk," *Paperi Ja Puu—Paper And Timber,* vol. 74, No. 3, 1992, pp. 232–242.

Mummery, Leigh, *Surface Texture Analysis: The Handbook,* published by Hommelwerke GmbH, Muhlhausen, Germany, 1990, pp. 37–45.

Page, R.H. and J. Seyed–Yagoobi, "A New Concept For Air Or Vapor Impingement Drying," *Tappi Journal,* 73(9), Sep. 1990, pp. 229–234.

TAPPI Official Test Method T 494 om–88, "Tensile Breaking Properties Of Paper And Paperboard (Using Constant Rate Of Elongation Apparatus)," published by the TAPPI Press, Atlanta, Georgia, revised 1988, pp. 1–5.

TAPPI Useful Method UM 256, "Water Retention Value (WRV)," published by the TAPPI Press, Atlanta, Georgia, pp. 54–56.

Thiele, P.E. and R.H. Page, "Enhancement Of Drying Rate, Moisture Profiling And Sheet Stability On An Existing Paper Machine With RJR Blow Boxes," *1995 Papermakers Conference,* Tappi Press, Atlanta, Georgia, 1995, pp. 223–228.

METHOD FOR MAKING CELLULOSIC WEB WITH REDUCED ENERGY INPUT

This application is a C-I-P of Ser. No. 08/647,508 filed May 14, 1996, Abnd.

BACKGROUND OF THE INVENTION

The present invention relates generally to methods for making cellulosic webs. More particularly, the invention concerns methods for making low-density paper products such as tissue with reduced energy input.

In the manufacture of paper products such as paper towels, napkins, tissue, wipes, and the like, there are generally two different methods of making the base sheets. These methods are commonly referred to as wet-pressing and throughdrying. While the two methods may be the same at the front end and back end of the process, they differ significantly in the manner in which water is removed from the wet web after its initial formation.

More specifically, in the wet-pressing method, the newly-formed wet web is typically transferred onto a papermaking felt and thereafter pressed against the surface of a steam-heated Yankee dryer while it is still supported by the felt. The dewatered web, typically having a consistency of about 40 percent, is then dried while on the hot surface of the Yankee. The web is then creped to soften it and provide stretch to the resulting sheet. A disadvantage of wet pressing is that the pressing step densifies the web, thereby decreasing the bulk and absorbency of the sheet. The subsequent creping step only partially restores these desirable sheet properties.

In the throughdrying method, the newly-formed web is transferred to a relatively porous fabric and non-compressively dried by passing hot air through the web. The resulting web can then be transferred to a Yankee dryer for creping. Because the web is substantially dry when transferred to the Yankee, the density of the web is not significantly increased by the transfer. Also, the density of a throughdried sheet is relatively low by nature because the web is dried while supported on the throughdrying fabric. The disadvantages of the throughdrying method, though, are the operational energy cost and the capital costs associated with the throughdryers.

In the throughdrying process, water is removed by at least two processes: vacuum dewatering and then throughdrying. Vacuum dewatering is initially used to take the sheet from the post-forming consistency of around 10 percent to roughly 20–28 percent, depending on the particular furnish, speed and local energy costs. It is well known that the cost of water removal is relatively low at low consistencies, but increases exponentially as more water is removed. Hence, vacuum dewatering is generally used until the cost of additional water removal becomes higher than that of the succeeding throughdrying stage.

In the throughdrying stage, the energy cost again varies depending on the process and furnish specifics, but in all cases requires a minimum of 1000 BTU/pound of water removed because this is the latent heat of vaporization of water. In practice, generally about 1500 BTU are required per pound of water removed, with the additional BTU's related to the sensible heat needed to bring the water to the boiling point and energy losses in the system. Despite the relatively high energy input required for throughdrying, however, this process has become the process of choice for soft, bulky tissue because of the resulting product quality. For a new tissue machine producing premium quality tissue, it is often profitable to spend the additional capital and energy cost to make the desired product.

But, since the vast majority of existing tissue machines utilize the older wet-pressing method, it is of particular importance that manufacturers find ways to modify existing wet-pressed machines to produce the consumer-preferred low-density products without expensive modifications to the existing machines. Of course, it is possible to re-build wet-pressed machines to throughdried configurations, but this is usually prohibitively expensive. Many complicated and expensive changes are necessary to accommodate the throughdryers and associated equipment. Accordingly, there has been great interest in finding ways to modify existing wet-pressed machines without significantly altering the machine design.

One simple approach to modifying a wet-pressed machine to produce softer, bulkier tissue is described in U.S. Pat. No. 5,230,776 issued Jul. 27, 1993 to Andersson et al. The patent discloses replacing the felt with a perforated belt of wire type and sandwiching the web between the forming wire and this perforated belt up to the press roll. The patent also appears to disclose additional dewatering means, such as a steam blowing tube, a blowing nozzle, and/or a separate press felt, that may be placed within the range of the sandwich structure in order to further increase the dry solids content before the Yankee cylinder. These extra drying devices are said to permit the machine to run at speeds at least substantially equivalent to the speed of throughdrying machines.

It is important to reduce the moisture content of the web coming onto the Yankee dryer in order to maintain machine speed and to prevent blistering or lack of adhesion of the web. Referring to U.S. Pat. No. 5,230,776, the use of a separate press felt, however, tends to densify the web in the same manner as a conventional wet-pressing machine. The densification resulting from a separate press felt would thus negatively impact the bulk and absorbency of the web.

Further, jets of air for dewatering the web are not per se effective in terms of water removal or energy efficiency. Blowing air on the sheet for drying is well known in the art and used in the hoods of Yankee dryers for convective drying. In a Yankee hood, however, the vast majority of the air from the jets does not penetrate the web. Thus, if not heated to high temperatures, most of the air would be wasted and not effectively used to remove water. In Yankee dryer hoods, the air is heated to as high as 900 degrees Fahrenheit and high residence times are allowed in order to effectuate drying.

Thus, what is lacking and needed in the art is a method of making low-density tissue on a wet-pressed machine at conventional wet-pressed speeds, and in particular, a method that produces consumer-preferred low-density products with reduced energy input.

SUMMARY OF THE INVENTION

It has now been discovered that air streams can be used to noncompressively remove water from cellulosic webs in an energy efficient manner. More particularly, a wet-pressed machine can be modified to produce tissue with properties similar to those of a throughdried machine, while maintaining energy efficiency and productivity. The wet-pressed machine can be modified to produce tissue at less cost than a throughdried re-build while maintaining the productivity necessary to make the conversion economically feasible. More specifically, the wet-pressed tissue machine can be modified to economically produce low-density tissue with an energy/capital efficiency greater than that of the through-drying process.

Hence one embodiment of the invention concerns a method for making a cellulosic web comprising: a) depositing an aqueous suspension of papermaking fibers onto an endless forming fabric to form a wet web, the papermaking fibers having a water retention consistency; and b) non-compressively dewatering the web from a post forming consistency to a consistency from about 25 percent of the water retention consistency by passing air through the web with an Energy Efficiency at least 10 percent greater than that achievable using vacuum dewatering at the same speed.

The "water retention value" of a pulp specimen, referred to herein as the WRV, is a measure of the water retained by the wet pulp specimen after centrifuging under standard conditions. WRV can be a useful tool in evaluating the performance of pulps relative to dewatering behavior on a tissue machine. One suitable method for determining the WRV of a pulp is TAPPI Useful Method 256, which provides standard values of centrifugal force, time of centrifuging, and sample preparation. Various commercial test labs are available to perform WRV testing using the TAPPI test or a modified form thereof. For purposes of this invention, samples were submitted to Weyerhaeuser Technology Center in Tacoma, Wash. for testing.

In the mixed furnish blends as described in the examples below, the WRV is reported as the arithmetic average of the individual furnish constituents. WRV is reported as a ratio of grams of water to grams of fiber after centrifuging.

The "water retention consistency" of a pulp specimen, referred to herein as WRC, can be calculated from the WRV according to the following equation:

$$WRC = \left(\frac{1}{1 + WRV}\right) \times 100.$$

The term WRC is used herein because it represents the maximum consistency obtainable using non-thermal means for a pulp specimen having a given WRV.

The term "Energy Efficiency" (EE) as used herein means the post dewatering consistency divided by WRC for a given horsepower per inch (Hp/in) of sheet width. The non-thermal, non-compressive dewatering mechanism described herein provides improved Energy Efficiencies compared to conventional mechanisms such as vacuum dewatering, blow boxes, combinations thereof, and the like. Further, the energy requirements of the present non-thermal, noncompressive dewatering mechanism are significantly improved over throughdrying. Specifically, the present invention provides for noncompressive dewatering at significantly lower total energy consumption than the theoretical minimum of 1000 BTU/pound required for throughdrying, such as about 750 BTU/per pound of water removed or lower, particularly about 500 BTU/per pound of water removed or lower, and more particularly about 400 BTU/per pound of water removed or lower, such as about 350 BTU/per pound of water removed.

Vacuum dewatering is dewatering as generally practiced on paper machines, including throughdried tissue machines. Specifically, the sheet, supported by a continuous fabric, is carried over one or more slots or holes connected to a collection device for the resulting air/water stream, with a vacuum maintained beneath the sheet by a pump, usually a liquid ring pump, such as those supplied by Nash Engineering Company. The air/water mixture is sent to a separator, where the streams are separated using a standard air/water separator such as those supplied by Burgess Manning.

The sheet side opposite the vacuum slot is exposed to the ambient atmosphere such that the driving force for dewatering, commonly called the pressure drop across the sheet (or delta P), is the difference between vacuum level achieved in the vacuum box and atmospheric pressure (which is essentially zero inches mercury gauge of vacuum). Hence, the total dewatering driving force cannot exceed 29.92 inches of mercury at sea level, the difference between atmospheric pressure and a perfect vacuum. In actual practice, a driving force of no more than 25 inches is achieved, and this limits post dewatering consistencies to less than 30 percent at industrially useful speeds. Conversely, in the method of this invention, the driving force for dewatering can be much larger since a positive pressure device on the side opposite the collection device is integrally sealed relative to the web and is used to increase the dewatering force.

Hence, another embodiment of the invention concerns a method for making a cellulosic web, comprising the steps of: a) depositing an aqueous suspension of papermaking fibers onto an endless forming fabric to form a wet web, the papermaking fibers having a water retention consistency and the web having a sheet width; and b) non-compressively dewatering the web from a post forming consistency to a consistency of at least 70 percent of the water retention consistency by passing air through the web and using about 13 or less horsepower per inch of sheet width at a speed of 2500 feet per minute or greater.

Another embodiment of the invention concerns a method for making a cellulosic web, comprising the steps of: a) depositing an aqueous suspension of papermaking fibers onto an endless forming fabric to form a wet web, the papermaking fibers having a water retention consistency and the web having a sheet width; and b) non-compressively dewatering the web from a post forming consistency to a consistency of at least 80 percent of the water retention consistency by passing air through the web and using about 30 or less horsepower per inch of sheet width at a speed of 2500 feet per minute or greater.

Desirably, the wet tissue web is non-thermally and non-compressively dewatered using an air press comprising an air plenum and a vacuum box that are operatively connected and integrally sealed together. Pressurized fluid from the air plenum passes through the wet web and is evacuated in by the vacuum box. In particular embodiments, the air press is adapted to operate at a Pressure Ratio of about 3 or less. The term "Pressure Ratio" (PR) for purposes of the present invention is defined as absolute plenum or air pressure divided by vacuum pressure. Absolute pressure can be expressed in pounds per square inch absolute (psia). Conventional vacuum dewatering levels of about 20 inches of mercury vacuum or greater, and thus Pressure Ratios of about 3 or more, are generally needed to achieve high consistencies greater than about 20 percent.

As used herein, "noncompressive dewatering" and "non-compressive drying" refer to dewatering or drying methods, respectively, for removing water from cellulosic webs that do not involve compressive nips or other steps causing significant densification or compression of a portion of the web during the drying or dewatering process.

The terms "integral seal" and "integrally sealed" are used herein to refer to: the relationship between the air plenum and the wet web where the air plenum is operatively associated and in indirect contact with the web such that about 85 percent or more of the air fed to the air plenum flows through the web when the air plenum is operated at a pressure differential across the web of about 30 inches of mercury or greater; and the relationship between the air plenum and the collection device where the air plenum is operatively associated and in indirect contact with the web and the collection device such that about 85 percent or more of the air fed to the air plenum flows through the web into the collection device when the air plenum and collection device are operated at a pressure differential across the web of about 30 inches of mercury or greater.

Prior dewatering devices that merely positioned a steam blowing tube, a blowing nozzle or the like opposite a vacuum or suction box are not integrally sealed and are either unable to obtain comparable dewatering consistencies when operated at the same energy input, or require a significantly greater energy input to obtain the same dewatering consistency. The Examples discussed hereinafter compare the energy and dewatering characteristics of an integrally sealed air press and conventional dewatering devices.

The air press is able to dewater cellulosic webs to very high consistencies due in large part to the high pressure differential established across the web and the resulting air flow through the web. In particular embodiments, for example, the air press can increase the consistency of the wet web by about 3 percent or greater, particularly about 5 percent or greater, such as from about 5 to about 20 percent, more particularly about 7 percent or greater, and more particularly still about 7 percent or greater, such as from about 7 to 20 percent. Thus, the consistency of the wet web upon exiting the air press may be about 25 percent or greater, about 26 percent or greater, about 27 percent or greater, about 28 percent or greater, about 29 percent or greater, and is desirably about 30 percent or greater, particularly about 31 percent or greater, more particularly about 32 percent or greater, such as from about 32 to about 42 percent, more particularly about 33 percent or greater, even more particularly about 34 percent or greater, such as from about 34 to about 42 percent, and still more particularly about 35 percent or greater.

The air press is able to achieve these consistency levels while the machine is operating at industrially useful speeds. As used herein, "high-speed operation" or "industrially useful speed" for a tissue machine refers to a machine speed at least as great as any one of the following values or ranges, in feet per minute: 1,000; 1,500; 2,000; 2,500; 3,000; 3,500; 4,000; 4,500; 5,000, 5,500; 6,000; 6,500; 7,000; 8,000; 9,000; 10,000, and a range having an upper and a lower limit of any of the above listed values. Optional steam showers or the like may be employed before the air press to increase the post air press consistency and/or to modify the cross-machine direction moisture profile of the web. Furthermore, higher consistencies may be achieved when machine speeds are relatively low and the dwell time in the air press is relatively high.

The pressure differential across the wet web provided by the air press may be about 25 inches of mercury or greater, such as from about 25 to about 120 inches of mercury, particularly about 35 inches of mercury or greater, such as from about 35 to about 60 inches of mercury, and more particularly from about 40 to about 50 inches of mercury. This may be achieved in part by an air plenum of the air press maintaining a fluid pressure on one side of the wet web of greater than 0 to about 60 pounds per square inch gauge (psig), particularly greater than 0 to about 30 psig, more particularly about 5 psig or greater, such as about 5 to about 30 psig, and more particularly still from about 5 to about 20 psig. The collection device of the air press desirably functions as a vacuum box operating at 0 to about 29 inches of mercury vacuum, particularly 0 to about 25 inches of mercury vacuum, particularly greater than 0 to about 25 inches of mercury vacuum, and more particularly from about 10 to about 20 inches of mercury vacuum, such as about 15 inches of mercury vacuum. The collection device desirably but not necessarily forms an integral seal with the air plenum and draws a vacuum to facilitate its function as a collection device for air and liquid. Both pressure levels within both the air plenum and the collection device are desirably monitored and controlled to predetermined levels.

Significantly, the pressurized fluid used in the air press is sealed from ambient air to create a substantial air flow through the web, which results in the tremendous dewatering capability of the air press. The flow of pressurized fluid through the air press is suitably from about 5 to about 500 standard cubic feet per minute (SCFM) per square inch of open area, particularly about 10 SCFM per square inch of open area or greater, such as from about 10 to about 200 SCFM per square inch of open area, and more particularly about 40 SCFM per square inch of open area or greater, such as from about 40 to about 120 SCFM per square inch of open area. Desirably, 70 percent or greater, particularly 80 percent or greater, and more particularly 90 percent or greater, of the pressurized fluid supplied to the air plenum is drawn through the wet web into the vacuum box. For purposes of the present invention, the term "standard cubic feet per minute" means cubic feet per minute measured at 14.7 pounds per square inch absolute and 60 degrees Fahrenheit (° F.).

The terms "air" and "pressurized fluid" are used interchangeably herein to refer to any gaseous substance used in the air press to dewater the web. The gaseous substance suitably comprises air, steam or the like. Desirably, the pressurized fluid comprises air at ambient temperature, or air heated only by the process of pressurization to a temperature of about 300° F. or less, more particularly about 150° F. or less.

For purposes of the present application, air flow energy requirements for the air press and vacuum dewatering were calculated using the equipment performance data obtained from equipment manufacturers.

Vacuum horsepower for standard liquid ring vacuum pumps as conventionally used in tissue making was calculated using the following equations based on performance data published by Nash Engineering Company of Norwalk, Conn.

Horsepower per inch of Sheet Width=

$$((-0.03797)+(0.06150\times PR)+(3.97168\div SCFM))\times SCFM\div W;$$

where: PR=upstream psia/downstream psia;

SCFM=Airflow in standard cubic feet per minute, at 14.7 psia and 60° F.; and

W=sheet width in inches.

Compressed air horsepower for dual vane compressors was calculated using the following equation based on performance data published by Turblex Inc. of Springfield, Mo.

Horsepower per inch of Sheet Width=

$$((-0.05674)+(0.057009\times PR)+(18.79257\div SCFM))\times SCFM\div W;$$

where: PR=upstream psia/downstream psia;

SCFM=Airflow in standard cubic feet per minute, at 14.7 psia and 60° F.; and

W=sheet width in inches.

A comparison of the energy requirements for a vacuum pump and an air compressor, based on the foregoing equations, is graphically presented in FIG. 15. The following conclusions can be drawn from the equations and the graph: a) compressed air requires less energy than vacuum over the entire range of pressure differential investigated; for example, at 20 inches of mercury differential, compressed air requires 10 horsepower per inch of sheet width which is one third of the 30 horsepower per inch of sheet width required by vacuum; b) vacuum energy increases to infinity as absolute vacuum (29.92 inches of mercury) is approached, whereas compressed air energy increases linearly over the range of pressure differential examined; and c) compressed air can deliver greater differential than physically possible with vacuum, especially at higher elevations.

The energy requirements for other air-flow dewatering devices or equipment can be determined from performance data from the equipment manufacturer to calculate horsepower.

The present method is useful to make a variety of absorbent products, including facial tissue, bath tissue, towels, napkins, wipes, corrugate, liner board, newsprint, or the like. For purposes of the present invention, the term "cellulosic web" is used to broadly refer to webs comprising or consisting of cellulosic fibers regardless of the finished product structure.

Tissue webs may be dewatered and molded onto a three-dimensional fabric using the air press to have a bulk after molding of about 8 cubic centimeters per gram (cc/g) or greater, particularly about 10 cc/g or greater, and more particularly about 12 cc/g or greater, and that bulk may be maintained after being pressed onto the heated drying cylinder using the textured foraminous fabric.

In particular embodiments, the web can be partially dried on the heated drying cylinder and wet-creped at a consistency of from about 40 to about 80 percent and thereafter dried (after-dried) to a consistency of about 95 percent or greater. Suitable means for after-drying include one or more cylinder dryers, such as Yankee dryers or can dryers, throughdryers, or any other commercially effective drying means. Alternatively, the molded web can be completely dried on the heated drying cylinder and dry creped or removed without creping. The amount of drying on the heated drying cylinder will depend on such factors as the speed of the web, the size of the dryer, the amount of moisture in the web, and the like.

Various machine configurations and techniques for utilizing the energy efficient dewatering mechanism of the present invention are disclosed in U.S. patent application Ser. No. 08/647,508 filed May 14, 1996 now abandoned by M. Hermans et al. titled "Method and Apparatus for Making Soft Tissue"; U.S. patent application Ser. No. unknown filed on the same day as the present application by M. Hermans al. titled "Method For Making Tissue Sheets On A Modified Conventional Wet-Pressed Machine"; U.S. patent application Ser. No. unknown filed on the same day as the present application by F. Hada al. titled "Air Press For Dewatering A Wet Web"; U.S. patent application Ser. No. unknown filed on the same day as the present application by F. Druecke al. titled "Method Of Producing Low Density Resilient Webs"; and U.S. patent application Ser. No. unknown filed on the same day as the present application by S. L. Chen et al. titled "Low Density Resilient Webs And Methods Of Making Such Webs"; which are incorporated herein by reference.

Many fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or crosslinked fibers) or synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. Mixtures of any subset of the above mentioned or related fiber classes may be used. The fibers can be prepared in a multiplicity of ways known to be advantageous in the art. Useful methods of preparing fibers include dispersion to impart curl and improved drying properties, such as disclosed in U.S. Pat. Nos. 5,348,620 issued Sep. 20, 1994 and 5,501,768 issued Mar. 26, 1996, both to M. A. Hermans et al. and incorporated herein by reference.

Chemical additives may be also be used and may be added to the original fibers, to the fibrous slurry or added on the web during or after production. Such additives include opacifiers, pigments, wet strength agents, dry strength agents, softeners, emollients, humectants, viricides, bactericides, buffers, waxes, fluoropolymers, odor control materials and deodorants, zeolites, dyes, fluorescent dyes or whiteners, perfumes, debonders, vegetable and mineral oils, sizing agents, superabsorbents, surfactants, moisturizers, UV blockers, antibiotic agents, lotions, fungicides, preservatives, aloe-vera extract, vitamin E, or the like. The application of chemical additives need not be uniform, but may vary in location and from side to side in the tissue. Hydrophobic material deposited on a portion of the surface of the web may be used to enhance properties of the web.

A single headbox or a plurality of headboxes may be used. The headbox or headboxes may be stratified to permit production of a multilayered structure from a single headbox jet in the formation of a web. In particular embodiments, the web is produced with a stratified or layered headbox to preferentially deposit shorter fibers on one side of the web for improved softness, with relatively longer fibers on the other side of the web or in an interior layer of a web having three or more layers. The web is desirably formed on an endless loop of foraminous forming fabric which permits drainage of the liquid and partial dewatering of the web. Multiple embryonic webs from multiple headboxes may be couched or mechanically or chemically joined in the moist state to create a single web having multiple layers.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

DETAILED DESCRIPTION OF THE DRAWINGS

Figure 1:
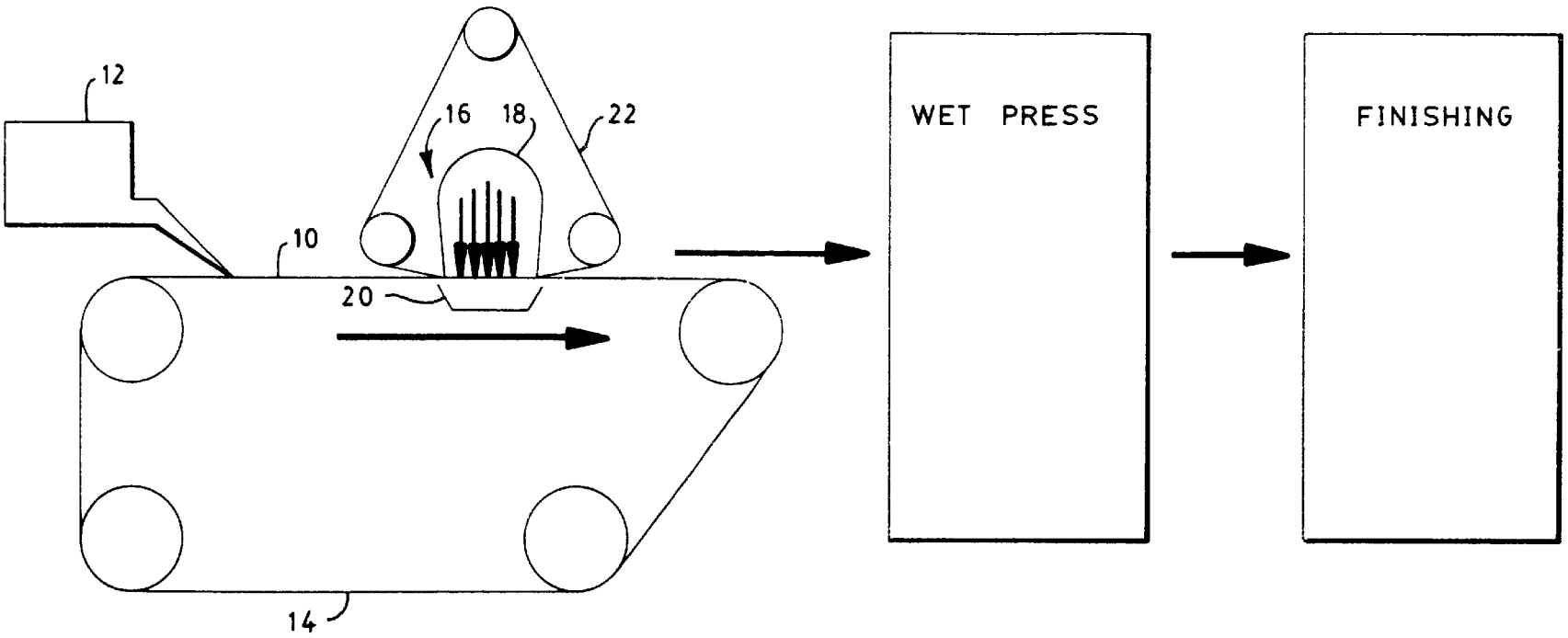
FIG. 1 representatively shows a process flow diagram of a method for producing low-density cellulosic webs.

The invention will now be described in greater detail with reference to the Figures, where similar elements in different Figures have been given the same reference numeral. For simplicity, the various tensioning rolls schematically used to define the several fabric runs are shown but not numbered. A variety of conventional papermaking apparatuses and operations can be used with respect to the stock preparation, headbox, forming fabrics, web transfers, creping and drying. Nevertheless, particular conventional components are illustrated for purposes of providing the context in which the various embodiments of the invention can be used.

The process of the present invention may be carried out on an apparatus as shown in FIG. 1. An embryonic paper web 10 formed as a slurry of papermaking fibers is deposited from a headbox 12 onto an endless loop of foraminous forming fabric 14. The consistency and flow rate of the slurry determines the dry web basis weight, which desirably is between about 5 and about 80 grams per square meter (gsm), and more desirably between about 8 and about 40 gsm.

The embryonic web 10 is partially dewatered by foils, suction boxes, and other devices known in the art (not shown) while carried on the forming fabric 14. For high-speed operation of the present invention, conventional tissue dewatering methods prior to the dryer cylinder provide inadequate and/or inefficient water removal, so additional dewatering means are needed. In the illustrated embodiment, an air press 16 is used to noncompressively dewater the web 10 prior to the drying cylinder. The illustrated air press 16 comprises an assembly of a pressurized air chamber 18 disposed above the web 10, a vacuum box 20 disposed beneath the forming fabric 14 in operable relation with the pressurized air chamber, and a support fabric 22. While passing through the air press 16, the wet web 10 is sandwiched between the forming fabric 14 and the support fabric 22 in order to facilitate sealing against the web without damaging the web.

The air press 16 provides substantial rates of water removal, enabling the web 10 to achieve dryness levels well over 30 percent prior to attachment to the Yankee, desirably without the requirement for substantial compressive dewatering. Several embodiments of the air press 16 are described in greater detail hereinafter. Other suitable embodiments are disclosed in U.S. patent application Ser. No. 08/647,508 filed May 14, 1996 now abandoned by M. A. Hermans et al. titled "Method and Apparatus for Making Soft Tissue"; and U.S. patent application Ser. No. unknown filed on the same day as the present application by F. Hada al. titled "Air Press For Dewatering A Wet Web."

The dewatered web 10 may then undergo a wet press process and finishing processes to make the desired final product. For example, the web 10 may be transferred from the forming fabric 14 onto a textured, foraminous fabric and the web 10 and textured fabric subsequently pressed onto the surface of a heated Yankee dryer. In particular embodiments, the web 10 may be rush transferred onto the textured fabric as disclosed in U.S. patent application Ser. No. unknown filed on the same day as the present application by M. Hermans al. titled "Method For Making Tissue Sheets On A Modified Conventional Wet-Pressed Machine." Alternatively, the air press 16 may be in conjunction with a throughdrying process as disclosed in U.S. patent application Ser. No. 08/647,508 filed May 14, 1996 now abandoned by M. Hermans et al. titled "Method and Apparatus for Making Soft Tissue."

An air press 200 for dewatering the wet web 10 is shown in FIGS. 2–5. The air press 200 generally comprises an upper air plenum 202 in combination with a lower collection device in the form of a vacuum box 204. The wet web 10 travels in a machine direction 205 between the air plenum 202 and vacuum box 204 while sandwiched between an upper support fabric 206 and a lower support fabric 208. The air plenum 202 and vacuum box 204 are operatively associated with one another so that pressurized fluid supplied to the air plenum 202 travels through the wet web 10 and is removed or evacuated through the vacuum box 204.

Each continuous fabric 206 and 208 travels over a series of rolls (not shown) to guide, drive and tension the fabric in a manner known in the art. The fabric tension is set to a predetermined amount, suitably from about 10 to about 60 pounds per lineal inch (pli), particularly from about 30 to about 50 pli, and more particularly from about 35 to about 45 pli. Fabrics that may be useful for transporting the wet web 10 through the air press 200 include almost any fluid permeable fabric, for example Albany International 94M, Appleton Mills 2164B, or the like.

Figure 2:
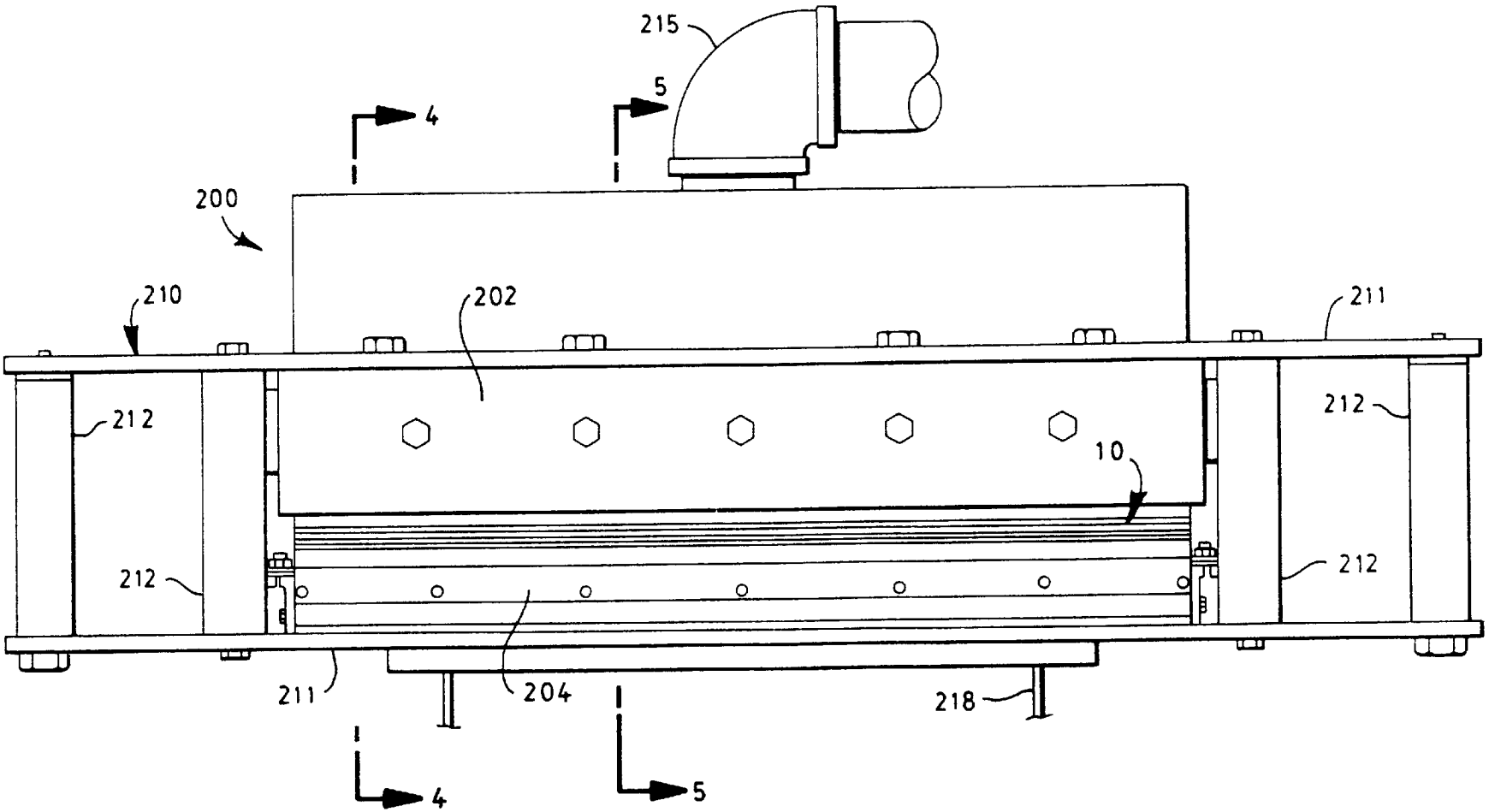
FIG. 2 representatively shows an enlarged end view of an air press for use in the method of FIG. 1, with an air plenum sealing assembly of the air press in a raised position relative to the wet web and vacuum box.
Figure 3:
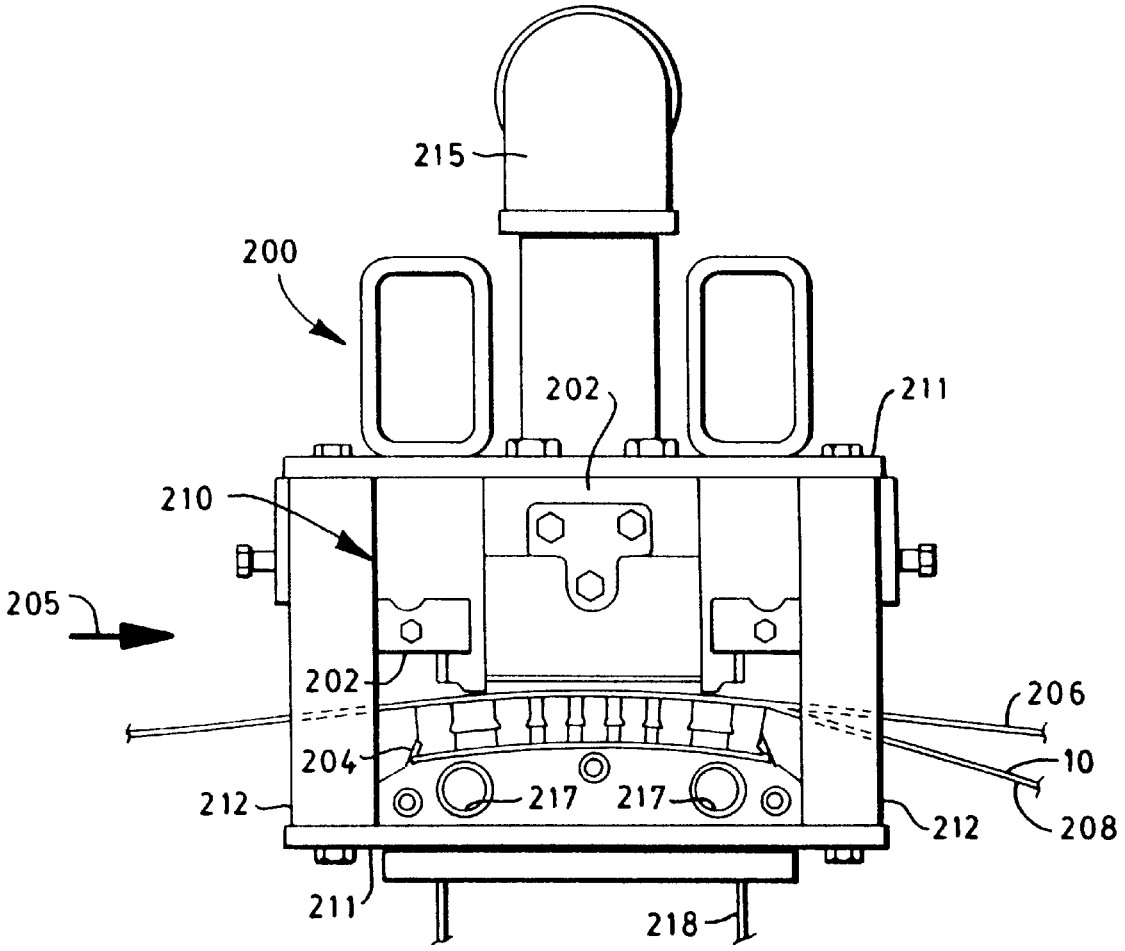
FIG. 3 representatively shows a side view of the air press of FIG. 2.

An end view of the air press 200 spanning the width of the wet web 10 is shown in FIG. 2, and a side view of the air press in the machine direction 205 is shown in FIG. 3. In both Figures, several components of the air plenum 202 are illustrated in a raised or retracted position relative to the wet web 10 and vacuum box 204. In the retracted position, effective sealing of pressurized fluid is not possible. For purposes of the present invention, a "retracted position" of the air press 200 means that the components of the air plenum 202 do not impinge upon the wet web 10 and support fabrics 206 and 208.

Figure 4:
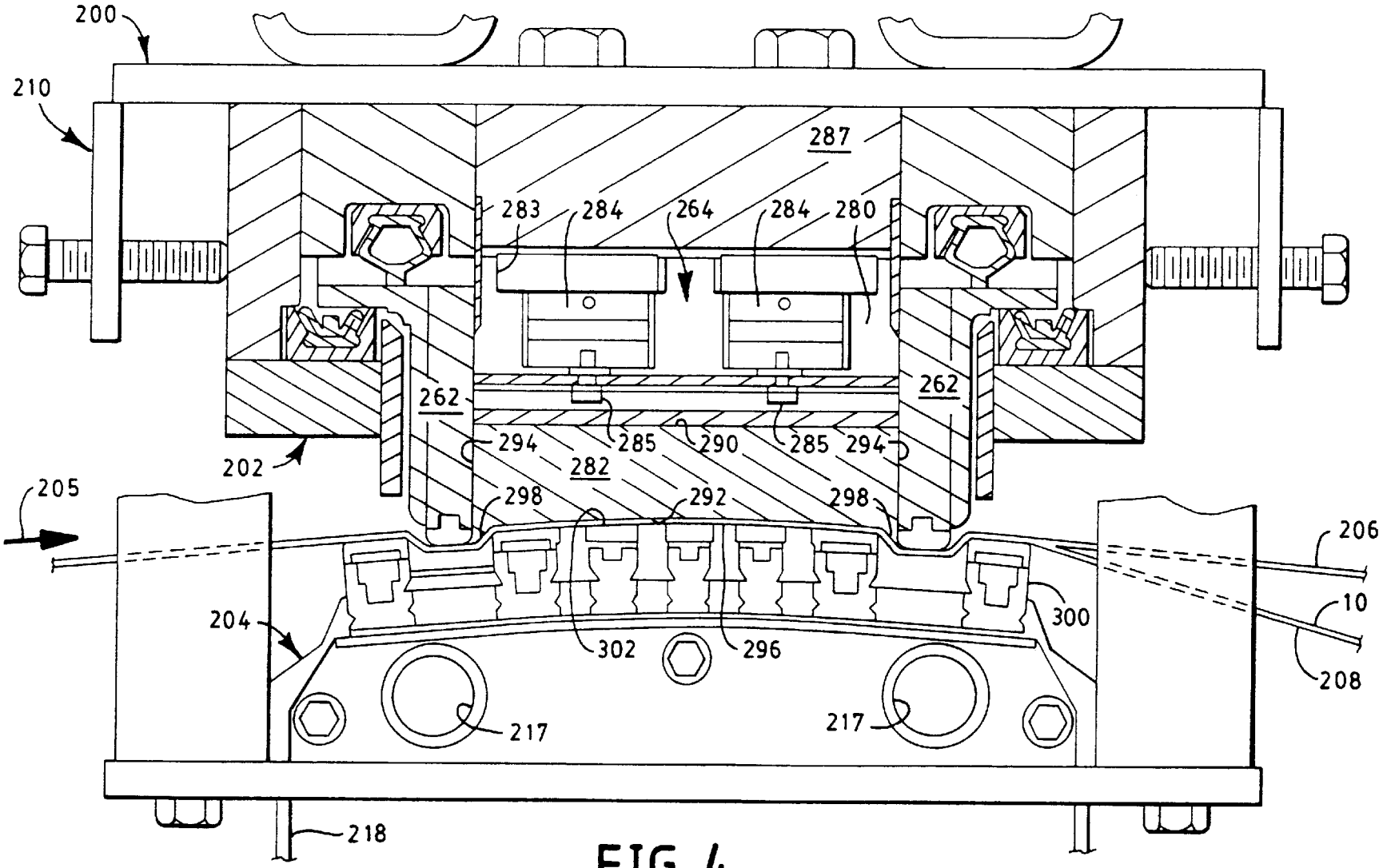
FIG. 4 representatively shows an enlarged section view taken generally from the plane of the line 4—4 in FIG. 2, but with the sealing assembly loaded against the fabrics.
Figure 5:
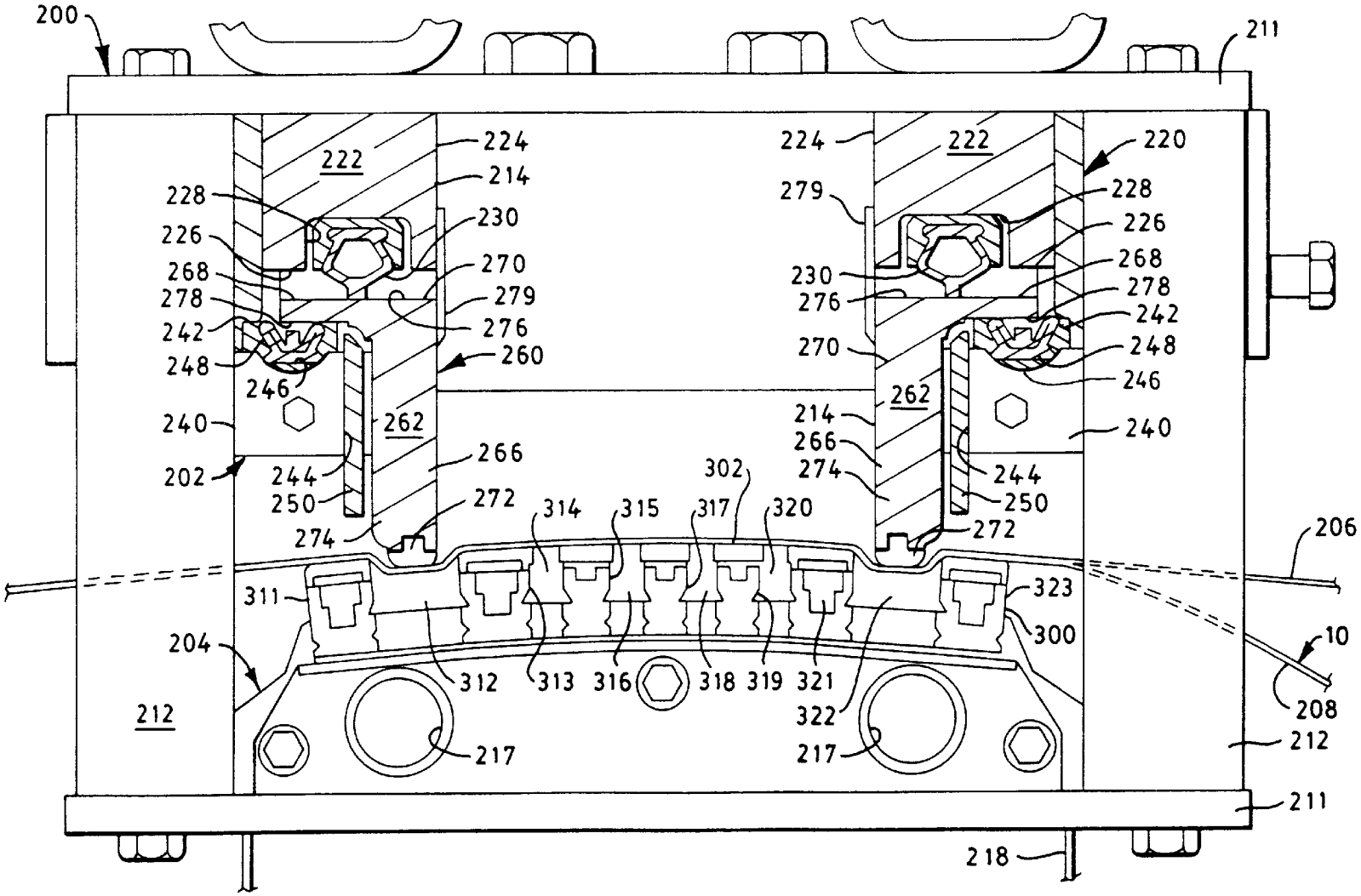
FIG. 5 representatively shows an enlarged section view similar to FIG. 4 but taken generally from the plane of the line 5—5 in FIG. 2.

The illustrated air plenum 202 and vacuum box 204 are mounted within a suitable frame structure 210. The illustrated frame structure 210 comprises upper and lower support plates 211 separated by a plurality of vertically oriented support bars 212. The air plenum 202 defines a chamber 214 (FIG. 5) that is adapted to receive a supply of pressurized fluid through one or more suitable air conduits 215 operatively connected to a pressurized fluid source (not shown). Correspondingly, the vacuum box 204 defines a plurality of vacuum chambers (described hereinafter in relation to FIG. 5) that are desirably operatively connected to low and high vacuum sources (not shown) by suitable fluid conduits 217 and 218, respectively (FIGS. 3, 4 and 5). The water removed from the wet web 10 is thereafter separated from the air streams. Various fasteners for mounting the components of the air press 200 are shown in the Figures but are not labeled.

Enlarged section views of the air press 200 are shown in FIGS. 4 and 5. In these Figures the air press 200 is shown in an operating position wherein components of the air plenum 202 are lowered into an impingement relationship with the wet web 10 and support fabrics 206 and 208. The degree of impingement that has been found to result in proper sealing of the pressurized fluid with minimal contact force and therefore reduced fabric wear is described in greater detail hereinafter.

The air plenum 202 comprises both stationary components 220 that are fixedly mounted to the frame structure 210 and a sealing assembly 260 that is movably mounted relative to the frame structure 210 and the wet web 10. Alternatively, the entire air plenum 202 could be moveably mounted relative to a frame structure 210.

With particular reference to FIG. 5, the stationary components 220 of the air plenum 202 include a pair of upper support assemblies 222 that are spaced apart from one another and positioned beneath the upper support plate 211. The upper support assemblies 222 define facing surfaces 224 that are directed toward one another and that partially define therebetween the plenum chamber 214. The upper support assemblies 222 also define bottom surfaces 226 that are directed toward the vacuum box 204. In the illustrated embodiment, each bottom surface 226 defines an elongated recess 228 in which an upper pneumatic loading tube 230 is fixedly mounted. The upper pneumatic loading tubes 230 are suitably centered the cross-machine direction and desirably extend over the full width of the wet web 10.

The stationary components 220 of the air plenum 202 also include a pair of lower support assemblies 240 that are spaced apart from one another and vertically spaced from the upper support assemblies 222. The lower support assemblies 240 define top surfaces 242 and facing surfaces 244. The top surfaces 242 are directed toward the bottom surfaces 226 of the upper support assemblies 222 and, as illustrated, define elongated recesses 246 in which lower pneumatic loading tubes 248 are fixedly mounted. The lower pneumatic loading tubes 248 are suitably centered in the cross-machine direction and suitably extend over about 50 to 100 percent of the width of the wet web 10. In the illustrated embodiment, lateral support plates 250 are fixedly attached to the facing surfaces 244 of the lower support assemblies 240 and function to stabilize vertical movement of the sealing assembly 260.

Figure 6:
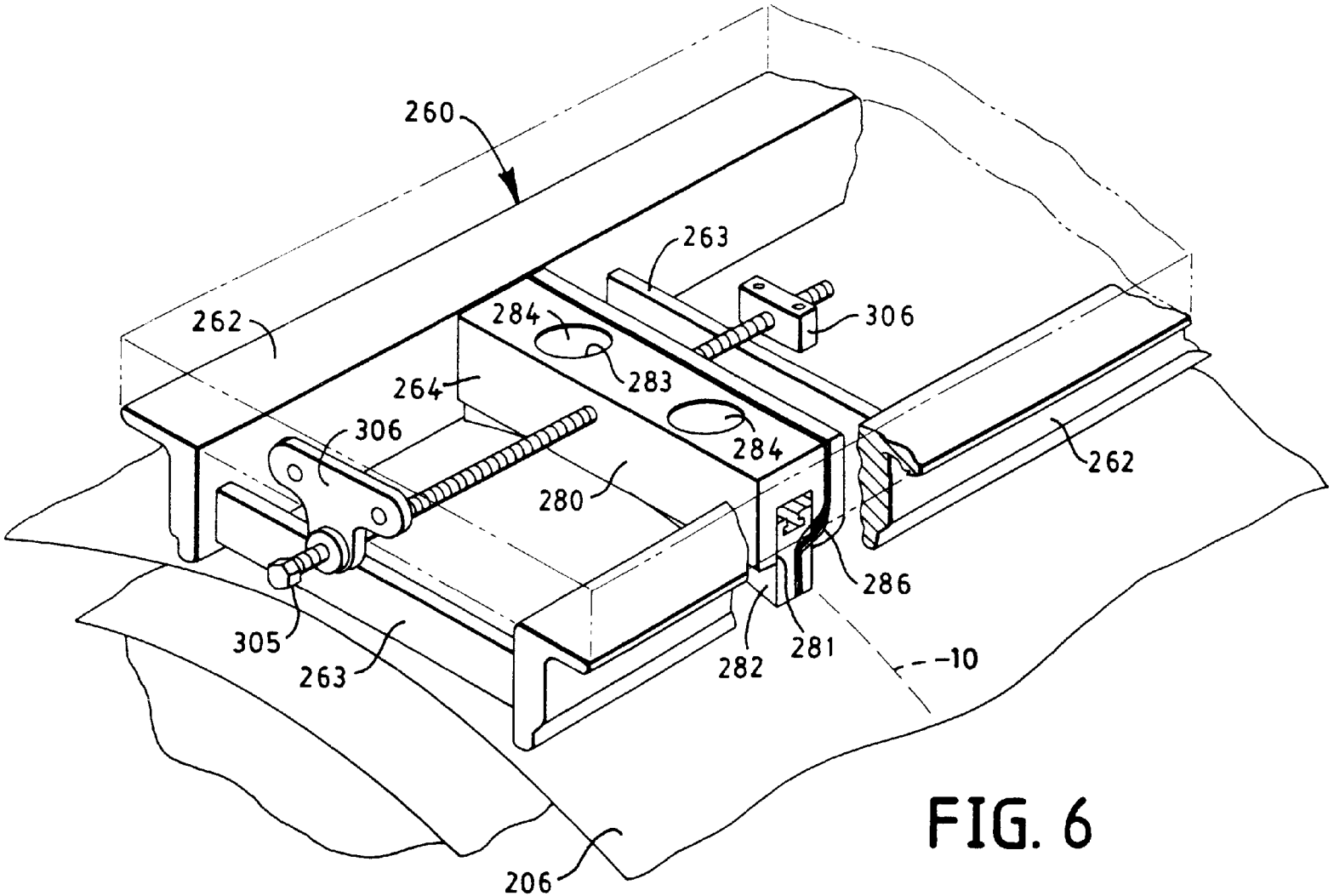
FIG. 6 representatively shows a perspective view of several components of the air plenum sealing assembly positioned against the fabrics, with portions broken away and shown in section for purposes of illustration.

With additional reference to FIG. 6, the sealing assembly 260 comprises a pair of cross-machine direction sealing members 262 referred to as CD sealing members 262, (FIGS. 4–6) that are spaced apart from one another, a plurality of braces 263 (FIG. 6) that connect the CD sealing members 262, and a pair of machine direction sealing members 264 referred to as MD sealing members 264, (FIGS. 4 and 6). The CD sealing members 262 are vertically moveable relative to the stationary components 220. The optional but desirable braces 263 are fixedly attached to the CD sealing members 262 to provide structural support, and thus move vertically along with the CD sealing members 262. In the machine direction 205, the MD sealing members 264 are disposed between the upper support assemblies 222 and between the CD sealing members 262. As described in greater detail hereinafter, portions of the MD sealing members 264 are vertically moveable relative to the stationary components 220. In the cross-machine direction, the MD sealing members 264 are positioned near the edges of the wet web 10. In one particular embodiment, the MD sealing members 264 are moveable in the cross-machine direction in order to accommodate a range of possible wet web widths.

The illustrated CD sealing members 262 include a main upright wall section 266, a transverse flange 268 projecting outwardly from a top portion 270 of the wall section 266, and a sealing blade 272 mounted on an opposite bottom portion 274 of the wall section 266 (FIG. 5). The outwardly-projecting flange 268 thus forms opposite, upper and lower control surfaces 276 and 278 that are substantially perpendicular to the direction of movement of the sealing assembly 260. The wall section 266 and flange 268 may comprise separate components or a single component as illustrated.

As noted above, the components of the sealing assembly 260 are vertically moveable between the retracted position, shown in FIGS. 2 and 3, and the operating position, shown in FIGS. 4 and 5. In particular, the wall sections 266 of the CD sealing members 262 are positioned inward of the position control plates 250 and are slideable relative thereto. The amount of vertical movement is determined by the ability of the transverse flanges 268 to move between the bottom surfaces 226 of the upper support assemblies 222 and the top surfaces 242 of the lower support assemblies 240.

The vertical position of the transverse flanges 268 and thus the CD sealing members 262 is controlled by activation of the pneumatic loading tubes 230 and 248. The loading tubes are operatively connected to a pneumatic source and to a control system (not shown) for the air press 200. Activation of the upper loading tubes 230 creates a downward force on the upper control surfaces 276 of the CD sealing members 262 resulting in a downward movement of the flanges 268 until they contact the top surfaces 242 of the lower support assemblies 240 or are stopped by an upward force caused by the lower loading tubes 248 or the fabric tension. Retraction of the CD sealing members 262 is achieved by activation of the lower loading tubes 248 and deactivation of the upper loading tubes 248. In this case, the lower loading tubes press upwardly on the lower control surfaces 278 and cause the flanges 268 to move toward the bottom surfaces 226 of the upper support assemblies 222. Of course, the upper and lower loading tubes 230 and 248 can be operated at differential pressures to establish movement of the CD sealing members 262. Alternative means for controlling vertical movement of the CD sealing members 262 can comprise other forms and connections of pneumatic cylinders, hydraulic cylinders, screws, jacks, mechanical linkages, or other suitable means. Suitable loading tubes 230 and 248 are available from Seal Master Corporation of Kent, Ohio.

As shown in FIG. 5, a pair of bridge plates 279 span the gap between the upper support assemblies 222 and the CD sealing members 262 to prevent the escape of pressurized fluid. The bridge plates 279 thus define part of the air plenum chamber 214. The bridge plates 279 may be fixedly attached to the facing surfaces 224 of the upper support assemblies 222 and slideable relative to the inner surfaces of the CD sealing members 262, or vice versa. The bridge plates 279 may be formed of a fluid impermeable, semi-rigid, low-friction material such as LEXAN, sheet metal or the like.

The sealing blades 272 function together with other features of the air press 200 to minimize the escape of pressurized fluid between the air plenum 202 and the wet web 10 in the machine direction. Additionally, the sealing blades 272 are desirably shaped and formed in a manner that reduces the amount of fabric wear. In particular embodiments, the sealing blades 272 are formed of resilient plastic compounds, ceramic, coated metal substrates, or the like.

With particular reference to FIGS. 4 and 6, the MD sealing members 264 are spaced apart from one another and adapted to prevent the loss of pressurized fluid along the side edges of the air press 200. FIGS. 4 and 6 each show one of the MD sealing members 264, which are positioned in the cross-machine direction near the edge of the wet web 10. As illustrated, each MD sealing member 264 comprises a transverse support member 280, an end deckle strip 282 operatively connected to the transverse support member 280, and actuators 284 for moving the end deckle strip 282 relative to the transverse support member 280. The transverse support members 280 are normally positioned near the side edges of the wet web 10 and are generally located between the CD sealing members 262. As illustrated, each transverse support member 280 defines a downwardly directed channel 281 (FIG. 6) in which the [an] end deckle strip 282 is mounted. Additionally, each transverse support member defines circular apertures 283 in which the actuators 284 are mounted.

The end deckle strips 282 are vertically moveable relative to the transverse support members 280 due to the cylindrical actuators 284. Coupling members 285 (FIG. 4) link the end deckle strips 282 to the output shaft of the cylindrical actuators 284. The coupling members 285 may comprise an inverted T-shaped bar or bars so that the end deckle strips 282 may slide within the channel 281, such as for replacement.

As shown in FIG. 6, both the transverse support members 280 and the end deckle strips 282 define slots to house a fluid impermeable sealing strip 286, such as O-ring material or the like. The sealing strip 286 helps seal the air chamber 214 of the air press 200 from leaks. The slots in which the sealing strip 286 resides is desirably widened at the interface between the transverse support members 280 and the end deckle strips 282 to accommodate relative movement between those components.

A bridge plate 287 (FIG. 4) is positioned between the MD sealing members 264 and the upper support plate 211 and fixedly mounted to the upper support plate 211. Lateral portions of the air chamber 214 (FIG. 5) are defined by the bridge plate 287. Sealing means, such as a fluid impervious gasketing material, is desirably positioned between the bridge plate 287 and the MD sealing members 264 to permit relative movement therebetween and to prevent the loss of pressurized fluid.

The actuators 284 suitably provide controlled loading and unloading of the end deckle strips 282 against the upper support fabric 206, independent of the vertical position of the CD sealing members 262. The load can be controlled exactly to match the necessary sealing force. The end deckle strips 282 can be retracted when not needed to eliminate all end deckle and fabric wear. Suitable actuators 284 are available from Bimba Corporation. Alternatively, springs (not shown) may be used to hold the end deckle strips 282 against the fabric 206 although the ability to control the position of the end deckle strips 282 may be sacrificed.

With reference to FIG. 4, each end deckle strip 282 has a top surface or edge 290 disposed adjacent to the coupling members 285, an opposite bottom surface or edge 292 that resides during use in contact with the fabric 206, and lateral surfaces or edges 294 that are in close proximity to the CD sealing members 262. The shape of the bottom surface 292 is suitably adapted to match the curvature of the vacuum box 204. Where the CD sealing members 262 impinge upon the fabrics 206 and 208, the bottom surface 292 is desirably shaped to follow the curvature of the fabric impingement. Thus, the bottom surface 292 has a central portion 296 that is laterally surrounded in the machine direction by spaced apart end portions 298. The shape of the central portion 296 generally tracks the shape of the vacuum box 204 while the shape of the end portions 298 generally tracks the deflection of the fabrics 206 and 208 caused by the CD sealing members 262. To prevent wear on the projecting end portions 298, the end deckle strips 282 are desirably retracted before the CD sealing members 262 are retracted. The end deckle strips 282 are desirably formed of a gas impermeable material that minimizes fabric wear. Particular materials that may be suitable for the end deckles include polyethylene, nylon, or the like.

The MD sealing members 264 are desirably moveable in the cross-machine direction and are thus desirably slideably positioned against the CD sealing members 262. In the illustrated embodiment, movement of the MD sealing members 264 in the cross-machine direction is controlled by a threaded shaft or bolt 305 that is held in place by brackets 306 (FIG. 6). The threaded shaft 305 passes through a threaded aperture in the transverse support member 280 and rotation of the shaft causes the MD sealing member 264 to move along the shaft 305. Alternative means for moving the MD sealing members 264 in the cross-machine direction such as pneumatic devices or the like may also be used. In one alternative embodiment, the MD sealing members 264 are fixedly attached to the CD sealing members 262 so that the entire sealing assembly 260 is raised and lowered together (not shown). In another alternative embodiment, the transverse support members 280 are fixedly attached to the CD sealing members 262 and the end deckle strips 282 are adapted to move independently of the CD sealing members 262 (not shown).

Referring again to FIGS. 4 and 5, the vacuum box 204 comprises a cover 300 having a top surface 302 over which the lower support fabric 208 travels. The vacuum box cover 300 and the sealing assembly 260 are desirably gently curved to facilitate web control. The illustrated vacuum box cover 300 is formed, from the leading edge to the trailing edge in the machine direction 205, with a first exterior sealing shoe 311, a first sealing vacuum zone 312, a first interior sealing shoe 313, a series of four high vacuum zones 314, 316, 318 and 320 surrounding three interior shoes 315, 317 and 319, a second interior sealing shoe 321, a second sealing vacuum zone 322, and a second exterior sealing shoe 323 (FIG. 5). Each of these shoes and zones desirably extend in the cross-machine direction across the full width of the web 10. The shoes each include a top surface desirably formed of a ceramic material to ride against the lower support fabric 208 without causing significant fabric wear. Suitable vacuum box covers 300 and shoes may be formed of plastics, NYLON, coated steels or the like, and are available from JWI Corporation or IBS Corporation.

The four high vacuum zones 314, 316, 318 and 320 are passageways in the vacuum box cover 300 that are operatively connected to one or more vacuum sources (not shown) that draw a relatively high vacuum level. For example, the high vacuum zones 314, 316, 318 and 320 may be operated at a vacuum of 0 to 25 inches of mercury vacuum, and more particularly about 10 to about 25 inches of mercury vacuum. As an alternative to the illustrated passageways, the vacuum box cover 300 could define a plurality of holes or other shaped openings (not shown) that are connected to a vacuum source to establish a flow of pressurized fluid through the web 10. In one embodiment, the high vacuum zones 314, 316, 318 and 320 comprise slots each measuring 0.375 inch in the machine direction and extending across the full width of the wet web 10. The dwell time that any given point on the web 10 is exposed to the flow of pressurized fluid, which in the illustrated embodiment is the time over slots 314, 316, 318 and 320, is suitably about 10 milliseconds or less, particularly about 7.5 milliseconds or less, more particularly 5 milliseconds or less, such as about 3 milliseconds or less or even about 1 millisecond or less. The number and width of the high pressure vacuum slots 314, 316, 318 and 320 and the machine speed determine the dwell time. The selected dwell time will depend on the type of fibers contained in the wet web 10 and the desired amount of dewatering.

The first and second sealing vacuum zones 312 and 322 may be employed to minimize the loss of pressurized fluid from the air press 200. The sealing vacuum zones 314, 316, 318 and 320 are passageways in the vacuum box cover 300 that may be operatively connected to one or more vacuum sources (not shown) that desirably draw a relatively lower vacuum level as compared to the four high vacuum zones 314, 316, 318 and 320. Specifically, the amount of vacuum that is desirable for the sealing vacuum zones 312 and 322 is 0 to about 100 inches water column, vacuum.

The air press 200 is desirably constructed so that the CD sealing members 262 are disposed within the sealing vacuum zones 312 and 322. More specifically, the sealing blade 272 of the CD sealing member 262 that is on the leading side of the air press 200 is disposed between, and more particularly centered between, the first exterior sealing shoe 311 and the first interior sealing shoe 313, in the machine direction. The trailing sealing blade 272 of the CD sealing member 262 is similarly disposed between, and more particularly centered between, the second interior sealing shoe 321 and the second exterior sealing shoe 323, in the machine direction. As a result, the sealing assembly 260 can be lowered so that the CD sealing members 262 deflect the normal course of travel of the wet web 10 and fabrics 206 and 208 toward the vacuum box 204, which is shown in slightly exaggerated scale in FIG. 5 for purposes of illustration.

The sealing vacuum zones 312 and 322 function to minimize the loss of pressurized fluid from the air press 200 across the width of the wet web 10. The vacuum in the sealing vacuum zones 312 and 322 draws pressurized fluid from the air plenum 202 and draws ambient air from outside the air press 200. Consequently, an air flow is established from outside the air press 200 into the sealing vacuum zones 312 and 322 rather than a pressurized fluid leak in the opposite direction. Due to the relative difference in vacuum between the high vacuum zones 314, 316, 318 and 320 and the sealing vacuum zones 312 and 322, though, the vast majority of the pressurized fluid from the air plenum 202 is drawn into the high vacuum zones 314, 316, 318 and 320 rather than the sealing vacuum zones 312 and 322.

Figure 7:
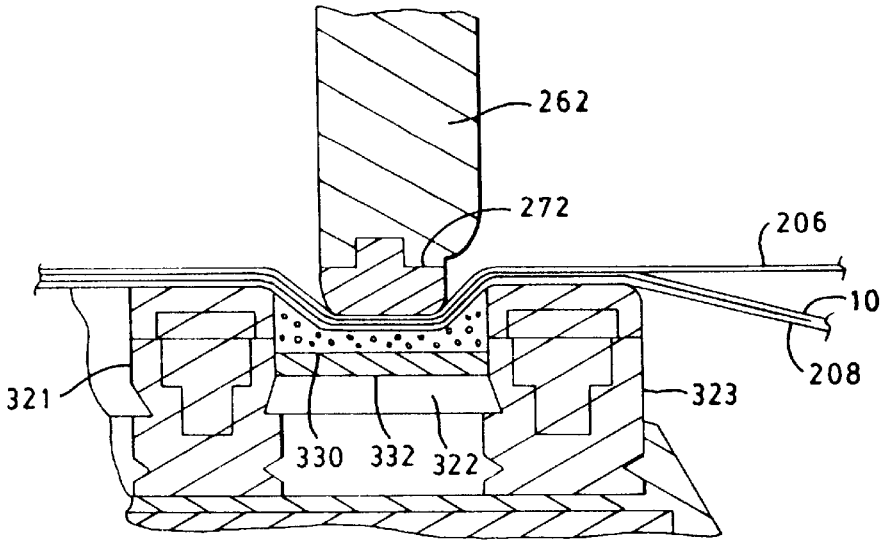
FIG. 7 representatively shows an enlarged section view of an alternative sealing configuration for the air press of FIG. 2.

In an alternative embodiment which is partially illustrated in FIG. 7, no vacuum is drawn in either or both of the sealing vacuum zones 312 and 322. Rather, deformable sealing deckles 330 are disposed in the sealing zones 312 and 322 (only 322 shown) to prevent leakage of pressurized fluid in the machine direction. In this case, the air press 200 is sealed in the machine direction by the sealing blades 272 that impinge upon the fabrics 206 and 208 and the wet web 10 and by the fabrics 206 and 208 and the wet web 10 being displaced in close proximity to or contact with the deformable sealing deckles 330. This configuration, where the CD sealing members 262 impinge upon the fabrics 206 and 208 and wet web 10 and the CD sealing members 262 are opposed on the other side of the fabrics 206 and 208 and the wet web 10 by deformable sealing deckles 330, has been found to produce a particularly effective air plenum seal.

The deformable sealing deckles 330 desirably extend across the full width of the wet web 10 to seal the leading end, the trailing end, or both the leading and the trailing end of the air press 200. The sealing vacuum zone 322 may be disconnected from the vacuum source when the deformable sealing deckle 330 extends across the full web width. Where the trailing end of the air press 200 employs a full width deformable sealing deckle 330, a vacuum device or blow box may be employed downstream of the air press 200 to cause the web 10 to remain with one of the fabrics 206 and 208 as the fabrics 206 and 208 are separated.

The deformable sealing deckles 330 desirably either comprise a material that preferentially wears relative to the fabric 208, meaning that when the fabric 208 and the material are in use the material will wear away without causing significant wear to the fabric 208, or comprise a material that is resilient and that deflects with impingement of the fabric 208. In either case, the deformable sealing deckles 330 are desirably gas impermeable, and desirably comprise a material with high void volume, such as a closed cell foam or the like. In one particular embodiment, the deformable sealing deckles 330 comprise a closed cell foam measuring 0.25 inch in thickness. Most desirably, the deformable sealing deckles 330 themselves become worn to match the path of the fabrics. The deformable sealing deckles 330 are desirably accompanied by a backing plate 332 for structural support, for example an aluminum bar.

In embodiments where full width sealing deckles are not used, sealing means of some sort are required laterally of the web. Deformable sealing deckles 330 as described above, or other suitable means known in the art, may be used to block the flow of pressurized fluid through the fabrics 206 and 208 laterally outward of wet web 10.

The degree of impingement of the CD sealing members 262 into the upper support fabric 206 uniformly across the width of the wet web 10 has been found to be a significant factor in creating an effective seal across the web 10. The requisite degree of impingement has been found to be a function of the maximum tension of the upper and lower support fabrics 206 and 208, the pressure differential across the web 10 and in this case between the air plenum chamber 214 and the sealing vacuum zones 312 and 322, and the gap between the CD sealing members 262 and the vacuum box cover 300.

Figure 8:
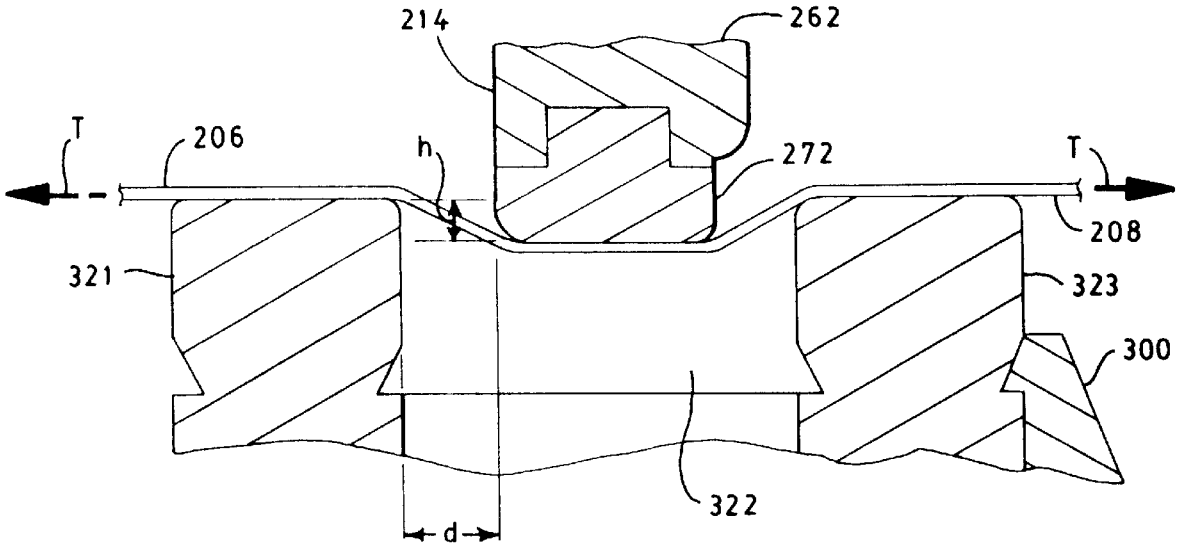
FIG. 8 representatively shows an enlarged schematic diagram of a sealing section of the air press of FIG. 2.

With additional reference to the schematic diagram of the trailing sealing section of the air press 200 shown in FIG. 8, the minimum desirable amount of impingement of the CD sealing member 262 into the upper support fabric 206, h(min), has been found to be represented by the following equation:

$$h(\min) = \frac{T}{W}\left(\cosh\left(\frac{Wd}{T}\right) - 1\right);$$

where: T is the tension of the fabrics measured in pounds per inch;

W is the pressure differential across the web measured in psi; and d is the gap in the machine direction measured in inches.

FIG. 8 shows the trailing CD sealing member 262 deflecting the upper support fabric 206 by an amount represented by arrow "h". The maximum tension of the upper and lower support fabrics 206 and 208 is represented by arrow "T". Fabric tension can be measured by a model tensometer available from Huyck Corporation or other suitable methods. The gap between the sealing blade 272 of the CD sealing member 262 and the second interior sealing shoe 321 measured in the machine direction and represented by arrow "d". The gap "d" of significance for the determining impingement is the gap on the higher pressure differential side of the sealing blade 272, that is, toward the plenum chamber 214, because the pressure differential on that side has the most effect on the position of the fabrics 206 and 208 and web 10. Desirably, the gap between the sealing blade 272 and the second exterior shoe 323 is approximately the same or less than gap "d".

Adjusting the vertical placement of the CD sealing members 262 to the minimum degree of impingement as defined above is a determinative factor in the effectiveness of the CD seal. The loading force applied to the sealing assembly 260 plays a lesser role in determining the effectiveness of the seal, and need only be set to the amount needed to maintain the requisite degree of impingement. Of course, the amount of fabric wear will impact the commercial usefulness of the air press 200. To achieve effective sealing without substantial fabric wear, the degree of impingement is desirably equal to or only slightly greater than the minimum degree of impingement as defined above. To minimize the variability of fabric wear across the width of the fabrics 206 and 208, the force applied to the fabric is desirably kept constant over the cross machine direction. This can be accomplished with either controlled and uniform loading of the CD sealing members 262 or controlled position of the CD sealing members 262 and uniform geometry of the impingement of the CD sealing members 262.

In use, a control system causes the sealing assembly 260 of the air plenum 202 to be lowered into an operating position. First, the CD sealing members 262 are lowered so that the sealing blades 272 impinge upon the upper support fabric 206 to the degree described above. More particularly, the pressures in the upper and lower loading tubes 230 and 248 are adjusted to cause downward movement of the CD sealing members 262 until movement is halted by the transverse flanges 268 contacting the lower support assemblies 240 or until balanced by fabric tension. Second, the end deckle strips 282 of the MD sealing members 264 are lowered into contact with or close proximity to the upper support fabric 206. Consequently, the air plenum 202 and vacuum box 204 are both sealed against the wet web 10 to prevent the escape of pressurized fluid.

The air press 200 is then activated so that pressurized fluid fills the air plenum 202 and an air flow is established through the web 10. In the embodiment illustrated in FIG. 5, high and low vacuums are applied to the high vacuum zones 314, 316, 318 and 320 and the sealing vacuum zones 312 and 322 to facilitate air flow, sealing and water removal. In the embodiment of FIG. 7, pressurized fluid flows from the air plenum 202 to the high vacuum zones 314, 316, 318 and 320 and the deformable sealing deckles 330 seal the air press 200 in the cross machine direction. The resulting pressure differential across the wet web 10 and resulting air flow through the web 10 provide for efficient dewatering of the web 10.

A number of structural and operating features of the air press 200 contribute to very little pressurized fluid being allowed to escape in combination with a relatively low amount of fabric wear. Initially, the air press 200 uses CD sealing members 262 that impinge upon the fabrics 206 and 208 and the wet web 10. The degree of impingement is determined to maximize the effectiveness of the CD seal. In one embodiment, the air press 200 utilizes the sealing vacuum zones 312 and 322 to create an ambient air flow into the air press 200 across the width of the wet web 10. In another embodiment, deformable sealing members 330 are disposed in the sealing vacuum zones 312 and 322 opposite the CD sealing members 262. In either case, the CD sealing members 262 are desirably disposed at least partly in passageways of the vacuum box cover 300 in order to minimize the need for precise alignment of mating surfaces between the air plenum 202 and the vacuum box 204. Further, the sealing assembly 260 can be loaded against a stationary component such as the lower support assemblies 240 that are connected to the frame structure 210. As a result, the loading force for the air press 200 is independent of the pressurized fluid pressure within the air plenum 202. Fabric wear is also minimized due to the use of low fabric wear materials and lubrication systems. Suitable lubrication systems may include chemical lubricants such as emulsified oils, debonders or other like chemicals, or water. Typical lubricant application methods include a spray of diluted lubricant applied in a uniform manner in the cross machine direction, an hydraulically or air atomized solution, a felt wipe of a more concentrated solution, or other methods well known in spraying system applications.

Observations have shown that the ability to run at higher pressure plenum pressures depends on the ability to prevent leaks. The presence of a leak can be detected from excessive air flows relative to previous or expected operation, additional operating noise, sprays of moisture, and in extreme cases, regular or random defects in the wet web 10 including holes and lines. Leaks can be repaired by the alignment or adjustment of the air press sealing components.

In the air press 200, uniform air flows in the cross-machine direction are desirable to provide uniform dewatering of a web 10. Cross-machine direction flow uniformity may be improved with mechanisms such as tapered ductwork on the pressure and vacuum sides, shaped using computational fluid dynamic modeling. Because web basis weight and moisture content may not be uniform in the cross-machine direction, is may be desirably to employ additional means to obtain uniform air flow in the cross-machine direction, such as independently-controlled zones with dampers on the pressure or vacuum sides to vary the air flow based on sheet properties, a baffle plate to take a significant pressure drop in the flow before the wet web, or other direct means. Alternative methods to control CD dewatering uniformity may also include external devices, such as zoned controlled steam showers, for example a Devronizer steam shower available from Honeywell-Measurex Systems Inc. of Dublin, Ohio or the like.

EXAMPLES

The following examples are provided to give a more detailed understanding of the invention. The particular amounts, proportions, compositions and parameters are meant to be exemplary, and are not intended to specifically limit the scope of the invention. In each example, horsepower values were calculated by the method described above.

Example 1

A 50/50 blend of northern softwood kraft and eucalyptus pulp was pulped for 30 minutes at 4 percent consistency. The water retention value of the furnish blend was 1.37, yielding a WRC of 42.19. The fiber blend was formed into a sheet on a Lindsay 2164B forming fabric traveling at 2500 feet per minute. The resulting sheets, at basis weights of approximately 10 and 20 pounds/2880 $ft^2$ and a consistency of approximately 9 to 13 percent, were then further dewatered using vacuum. Test results obtained for Example 1 are shown below in Table 1 and are designated with a lower case "a."

Example 2

The experiments of Example 1 were repeated with an air press added to the system to augment and/or replace a portion of the vacuum dewatering system. A support fabric identical to the forming fabric was used to sandwich the web through the air press. The air plenum of the air press was pressurized with air at approximately 150 degrees Fahrenheit to 15 or 23 pounds per square inch gauge, and the vacuum box was operated at a constant 15 inches of mercury vacuum. The sheet was exposed to the resulting pressure differentials of 45 and 62 inches of mercury and air flows ranging from 58 to 135 SCFM per square inch of sheet width for dwell times of 0.75 or 2.25 milliseconds. The air press increased the consistency of the web by about 5–10% percent depending on the experimental conditions. Test results obtained for Example 2 are shown below in Table 1 and are designated with an upper case "A."

TABLE 1

| ID | Total Energy (HP/In of sheet width) | Post Dewatering Consistency (%) | Post Dewatering Consistency/ WRC |
|---|---|---|---|
| a | 7.6 | 23.5 | 0.56 |
| a | 8.3 | 25.8 | 0.61 |
| a | 7.4 | 26.2 | 0.61 |
| a | 8.1 | 23.2 | 0.55 |
| A | 32.4 | 33.8 | 0.80 |
| A | 18.7 | 29.5 | 0.70 |
| A | 19.1 | 31.8 | 0.75 |
| A | 16.9 | 30.1 | 0.71 |
| A | 23.5 | 35.5 | 0.84 |
| A | 21.3 | 35.8 | 0.85 |
| A | 24.0 | 34.9 | 0.83 |
| A | 10.6 | 32.1 | 0.76 |

In FIGS. 9–14, the symbol "■" (slightly smaller) is used to represent data where the web was dewatered using only vacuum boxes; the symbol "▼" is used to represent data where the web was dewatered using a combination of vacuum boxes and an air press; and a hollow square is used to represent data where the web was dewatered using only an air press.

FIGS. 9–13 represent graphs of consistency versus energy for the data from Examples 1–8. More specifically, these graphs show the post dewatering stage consistency achieved on the ordinate versus the total energy/inch expended in dewatering the furnish on the abscissa. Each furnish is shown to exhibit an idiosyncratic relationship between consistency and energy input.

Figure 15:
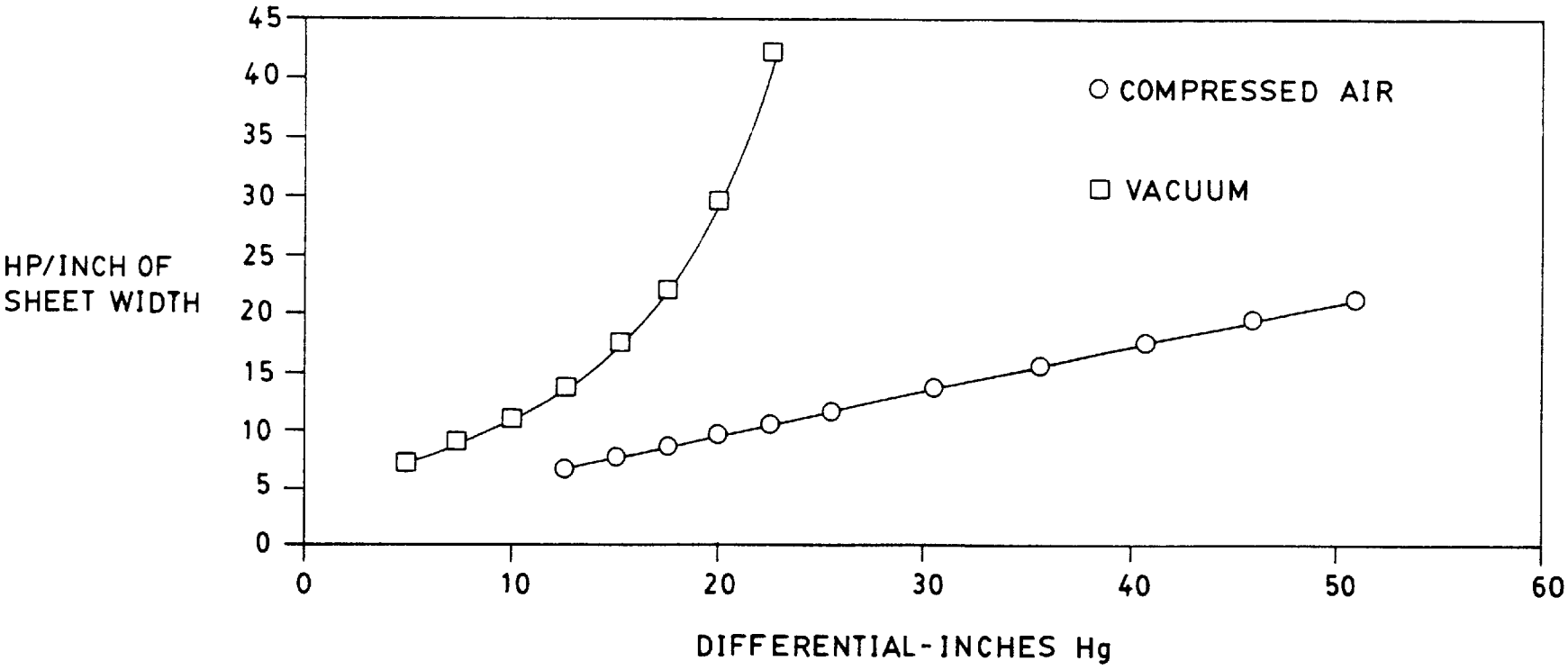
FIG. 15 representatively shows a graphical comparison of the energy requirements for a vacuum pump and an air compressor as described above.

For each of these graphs, it should be remembered that additional energy input to vacuum dewatering devices does not increase consistency in a linear relationship. As illustrated in FIG. 15, vacuum energy increases to infinity as absolute vacuum is approached.

Figure 9:
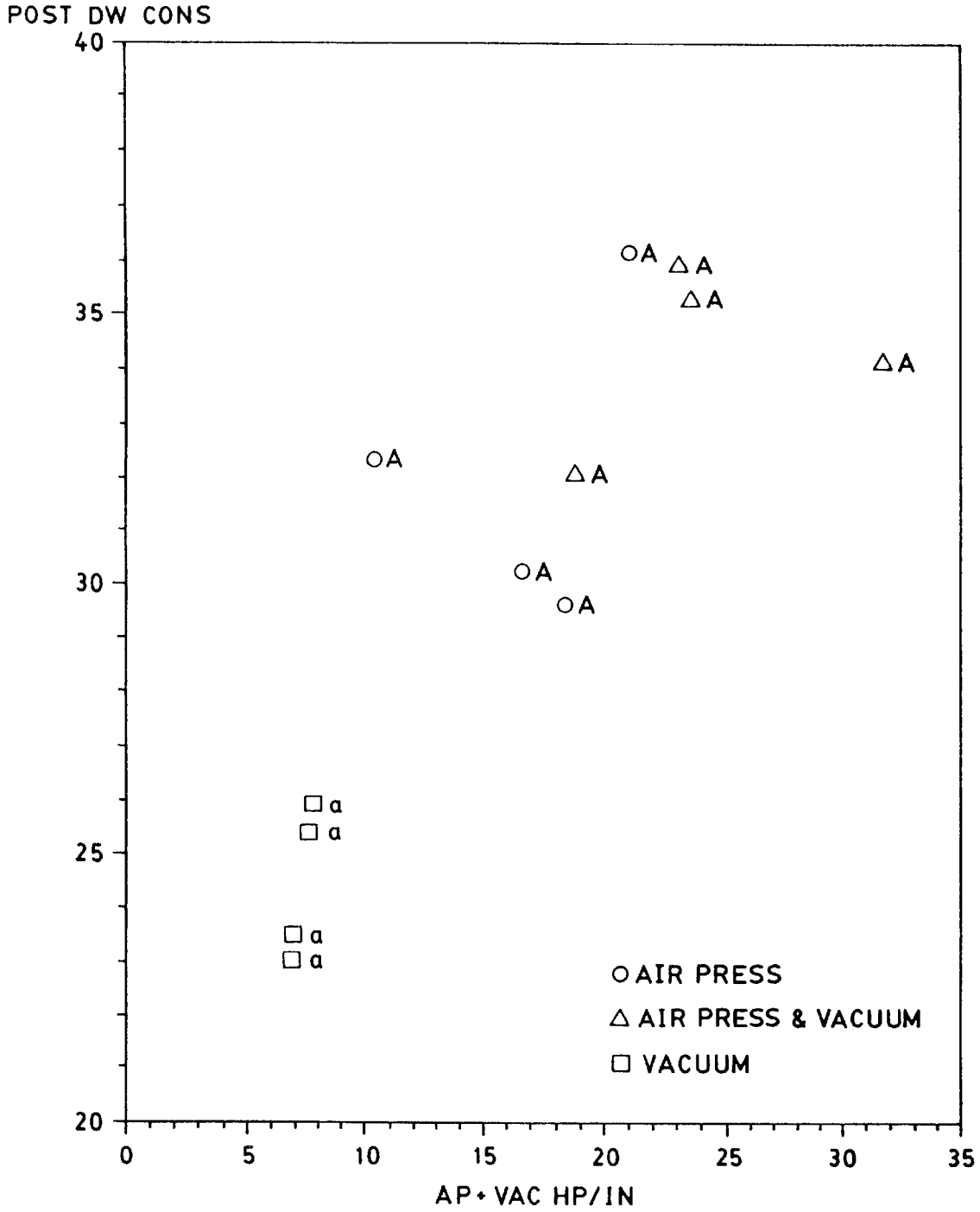
FIG. 9 representatively shows a graph of total energy versus post dewatering consistency for Examples 1 and 2 described hereinafter.

FIG. 9 represents a graph of total energy to dewater the web versus the post dewatering consistency for Examples 1 and 2. This graph illustrates that for the northern softwood kraft and eucalyptus furnish, the air press was able to achieve approximately 7 percent higher consistency than vacuum dewatering at a comparable energy input. Stated differently, based on the data of Table 1, the air press was able to dewater the furnish to more than 70% of the WRC, while vacuum dewatering was only able achieve roughly 60% of the WRC at a similar energy input.

Example 3

Similar experiments to those described in Example 1 were conducted with a 50/50 blend of northern softwood kraft and eucalyptus pulp that had been dispersed per U.S. Pat. No. 5,348,620, was pulped for 30 minutes at 4 percent consistency. The water retention value of the furnish blend was 1.33, yielding a WRC of 42.92. The fiber blend was formed into a sheet on a Lindsay 2164B forming fabric traveling at 2500 feet per minute. The resulting sheets, at basis weights of approximately 10 and 20 pounds/2880 $ft^2$ and a consistency of approximately 9 to 13 percent, were then further dewatered using vacuum. Test results obtained for Example 3 are shown below in Table 2 and are designated with a lower case "b."

Example 4

The experiments of Example 3 were repeated with an air press added to the system to augment and/or replace a portion of the vacuum dewatering system. A support fabric identical to the forming fabric was used to sandwich the web through the air press. The air plenum of the air press was pressurized with air at approximately 150 degrees Fahrenheit to 15 and 23 pounds per square inch gauge, and the vacuum box was operated at a constant 15 inches of mercury vacuum. The sheet was exposed to the resulting pressure differential of 45.5 and 62 inches of mercury and air flows of 65 to 129 SCFM per square inch for dwell times of 0.75 and 2.25 milliseconds. The air press increased the consistency of the web by about 6 to 15 percent. Test results obtained for Example 4 are shown below in Table 2 and are designated with an upper case B.

TABLE 2

| ID | Total Energy (HP/In of sheet width) | Post Dewatering Consistency (%) | Post Dewatering Consistency/ WRC |
|---|---|---|---|
| b | 7.7 | 20.5 | 0.48 |
| b | 7.5 | 25.8 | 0.60 |
| b | 7.4 | 21.9 | 0.51 |
| b | 7.2 | 26.2 | 0.61 |
| B | 28.1 | 32.0 | 0.75 |
| B | 26.9 | 32.1 | 0.75 |
| B | 28.7 | 35.9 | 0.84 |
| B | 12.0 | 30.3 | 0.71 |
| B | 29.8 | 39.2 | 0.91 |
| B | 16.2 | 32.9 | 0.76 |

TABLE 2-continued

| ID | Total Energy (HP/In of sheet width) | Post Dewatering Consistency (%) | Post Dewatering Consistency/ WRC |
|---|---|---|---|
| B | 18.6 | 36.5 | 0.85 |
| B | 18.6 | 36.8 | 0.85 |

Figure 10:
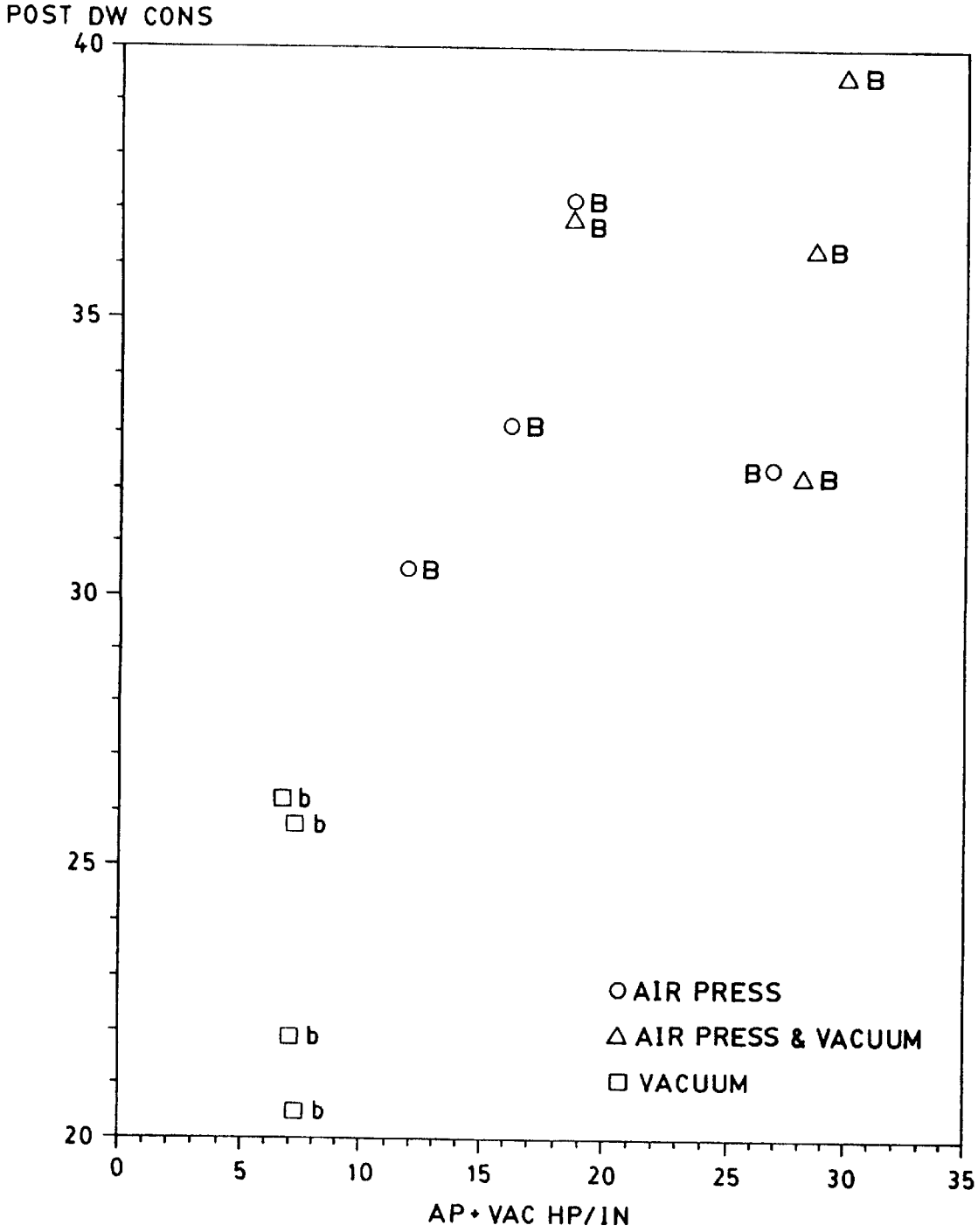
FIG. 10 representatively shows a graph of total energy versus post dewatering consistency for Examples 3 and 4 described hereinafter.

FIG. 10 represents a graph of total energy to dewater the web versus the post dewatering consistency for Examples 3 and 4. This graph illustrates that for the northern softwood kraft and dispersed eucalyptus furnish, the air press was able to achieve approximately 7 percent higher consistency than vacuum dewatering at a comparable energy input. Stated differently, based on the data of Table 2, the air press was able to dewater the furnish to more than 70% of the WRC, while vacuum dewatering was only able achieve roughly 50–60% of the WRC at a similar energy input.

Example 5

Similar experiments to those described in Example 1 were conducted with 100 percent recycled fiber (tissue deinked market pulp from Fox River Fiber in DePere, Wis. U.S.A.), being pulped for 30 minutes at 4 percent consistency. The water retention value of the furnish was 1.72, yielding a WRC of 36.76. The fiber was formed into a sheet on a Lindsay 2164B forming fabric traveling at 2500 feet per minute. The resulting sheets, at basis weights of approximately 10 and 20 pounds/2880 $ft^2$ and a consistency of approximately 9 to 13 percent, were then further dewatered using vacuum. Test results obtained for Example 5 are shown below in Table 3 and are designated with a lower case "C."

Example 6

The experiments of Example 5 were repeated with an air press added to the system to augment and/or replace a portion of the vacuum dewatering system. A support fabric identical to the forming fabric was used to sandwich the web through the air press. The air plenum of the air press was pressurized with air at approximately 150 degrees Fahrenheit to 15 and 23 pounds per square inch gauge, and the vacuum box was operated at a constant 15 inches of mercury vacuum. The sheet was exposed to the resulting pressure differentials of 45 and 62 inches of mercury and air flows of 43 to 124 SCFM per square inch for dwell times of 0.75 and 2.25 milliseconds. The air press increased the consistency of the web by about 2 to 8 percent. Test results obtained for Example 6 are shown below in Table 3 and are designated with an upper case "C."

TABLE 3

| ID | Total Energy (HP/In of sheet width) | Post Dewatering Consistency (%) | Post Dewatering Consistency/ WRC |
|---|---|---|---|
| c | 10.0 | 23.3 | 0.64 |
| c | 9.5 | 24.4 | 0.67 |
| c | 9.6 | 23.0 | 0.63 |
| c | 9.6 | 24.5 | 0.67 |
| C | 7.7 | 30.7 | 0.84 |
| C | 16.4 | 31.1 | 0.85 |
| C | 17.3 | 32.2 | 0.88 |

TABLE 3-continued

| ID | Total Energy (HP/In of sheet width) | Post Dewatering Consistency (%) | Post Dewatering Consistency/ WRC |
|---|---|---|---|
| C | 4.5 | 29.0 | 0.79 |
| C | 8.7 | 26.2 | 0.71 |
| C | 23.4 | 31.6 | 0.86 |
| C | 8.6 | 29.4 | 0.80 |
| C | 14.1 | 28.7 | 0.78 |

Figure 11:
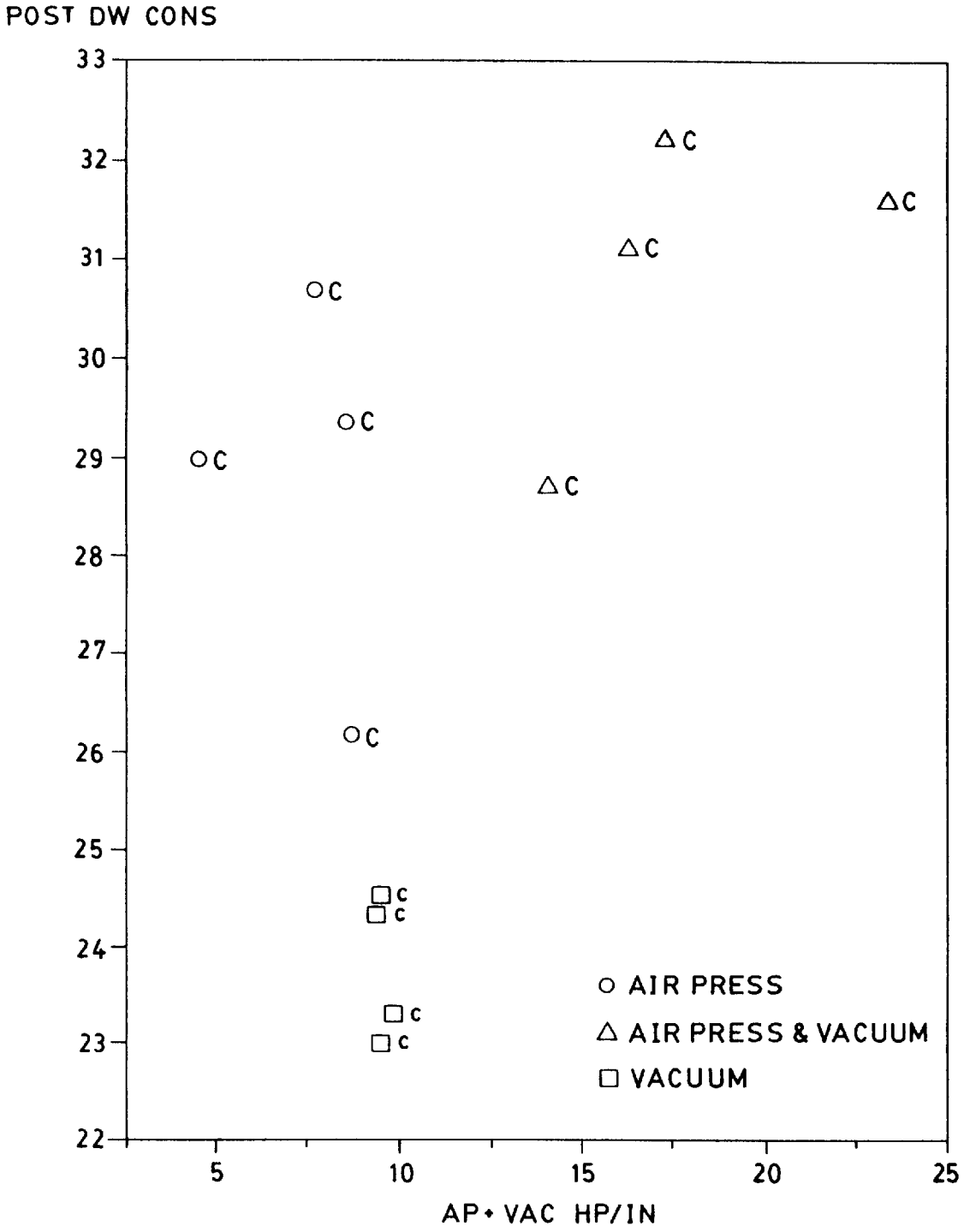
FIG. 11 representatively shows a graph of total energy versus post dewatering consistency for Examples 5 and 6 described hereinafter.

FIG. 11 represents a graph of total energy to dewater the web versus the post dewatering consistency for Examples 5 and 6. This graph illustrates that for the recycled fiber furnish, the air press was able to achieve approximately 5 percent higher consistency than vacuum dewatering at a comparable energy input. Stated differently, based on the data of Table 3, the air press was able to dewater the furnish to 70–85% of the WRC, while vacuum dewatering was only able achieve roughly 60–70% of the WRC at a similar energy input.

Example 7

Similar experiments to those described in Example 1 were conducted with a 25/75 blend of softwood BCTMP and southern hardwood kraft pulp being pulped for 30 minutes at 4 percent consistency. The water retention value of the furnish blend was 1.68, yielding a WRC of 37.31. The fiber blend was formed into a sheet on a Lindsay 2164B forming fabric traveling at 2500 feet per minute. The resulting sheets, at basis weights of approximately 10 and 20 pounds/2880 $ft^2$ and a consistency of approximately 9 to 13 percent, were then further dewatered using vacuum. Test results obtained for Example 7 are shown below in Table 4 and are designated with a lower case "d."

Example 8

The experiments of example 7 were repeated with an air press added to the system to augment and/or replace a portion of the vacuum dewatering system. A support fabric identical to the forming fabric was used to sandwich the web through the air press. The air plenum of the air press was pressurized with air at approximately 150 degrees Fahrenheit to 15 and 23 pounds per square inch gauge, and the vacuum box was operated at a constant 15 inches of mercury vacuum. The sheet was exposed to the resulting pressure differential of 45 and 62 inches of mercury and air flows of 66 to 174 SCFM per square inch for a dwell times of 0.75 and 2.25 milliseconds. The air press increased the consistency of the web by about 5–10 percent. Test results obtained for Example 8 are shown below in Table 4 and are designated with an upper case "D."

TABLE 4

| ID | Total Energy (HP/In of sheet width) | Post Dewatering Consistency (%) | Post Dewatering Consistency/ WRC |
|---|---|---|---|
| d | 10.7 | 22.3 | 0.60 |
| d | 12.1 | 23.6 | 0.63 |
| d | 10.7 | 22.2 | 0.58 |
| d | 12.0 | 23.8 | 0.63 |
| D | 5.6 | 28.7 | 0.77 |
| D | 18.9 | 33.2 | 0.89 |

TABLE 4-continued

| ID | Total Energy (HP/In of sheet width) | Post Dewatering Consistency (%) | Post Dewatering Consistency/ WRC |
|---|---|---|---|
| D | 6.6 | 30.1 | 0.81 |
| D | 15.5 | 28.9 | 0.77 |
| D | 17.1 | 29.7 | 0.78 |
| D | 8.9 | 27.6 | 0.73 |
| D | 18.7 | 29.9 | 0.79 |
| D | 3.7 | 24.8 | 0.65 |

Figure 12:
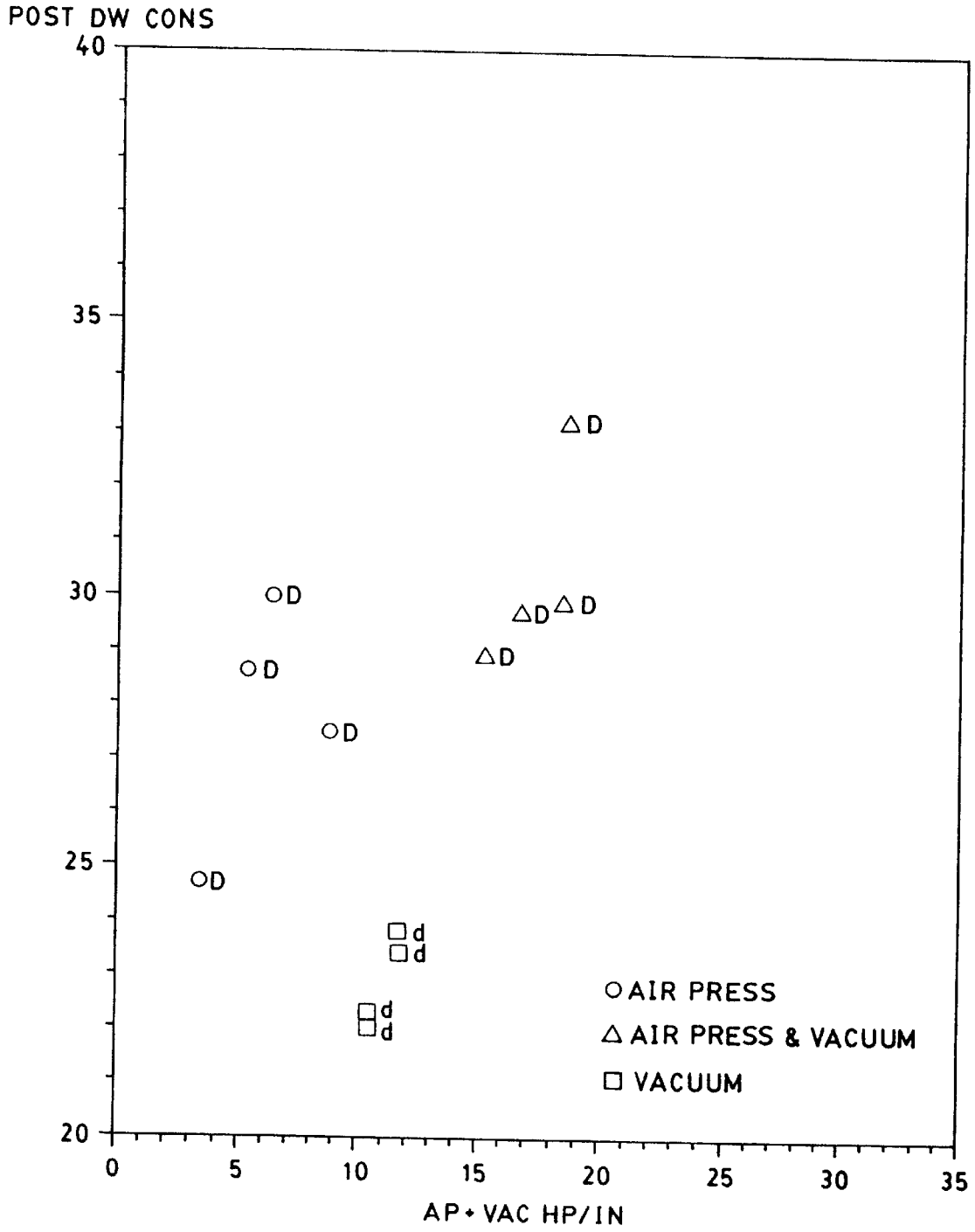
FIG. 12 representatively shows a graph of total energy versus post dewatering consistency for Examples 7 and 8 described hereinafter.

FIG. 12 represents a graph of total energy to dewater the web versus the post dewatering consistency for Examples 7 and 8. This graph illustrates that for the softwood BCMTP/southern hardwood kraft furnish, the air press was able to achieve approximately 5–6 percent higher consistency than vacuum dewatering at a comparable energy input. Stated differently, based on the data of Table 4, the air press was able to dewater the furnish to 70–80% of the WRC, while vacuum dewatering was only able achieve roughly 55–65% of the WRC at a similar energy input.

Figure 13:
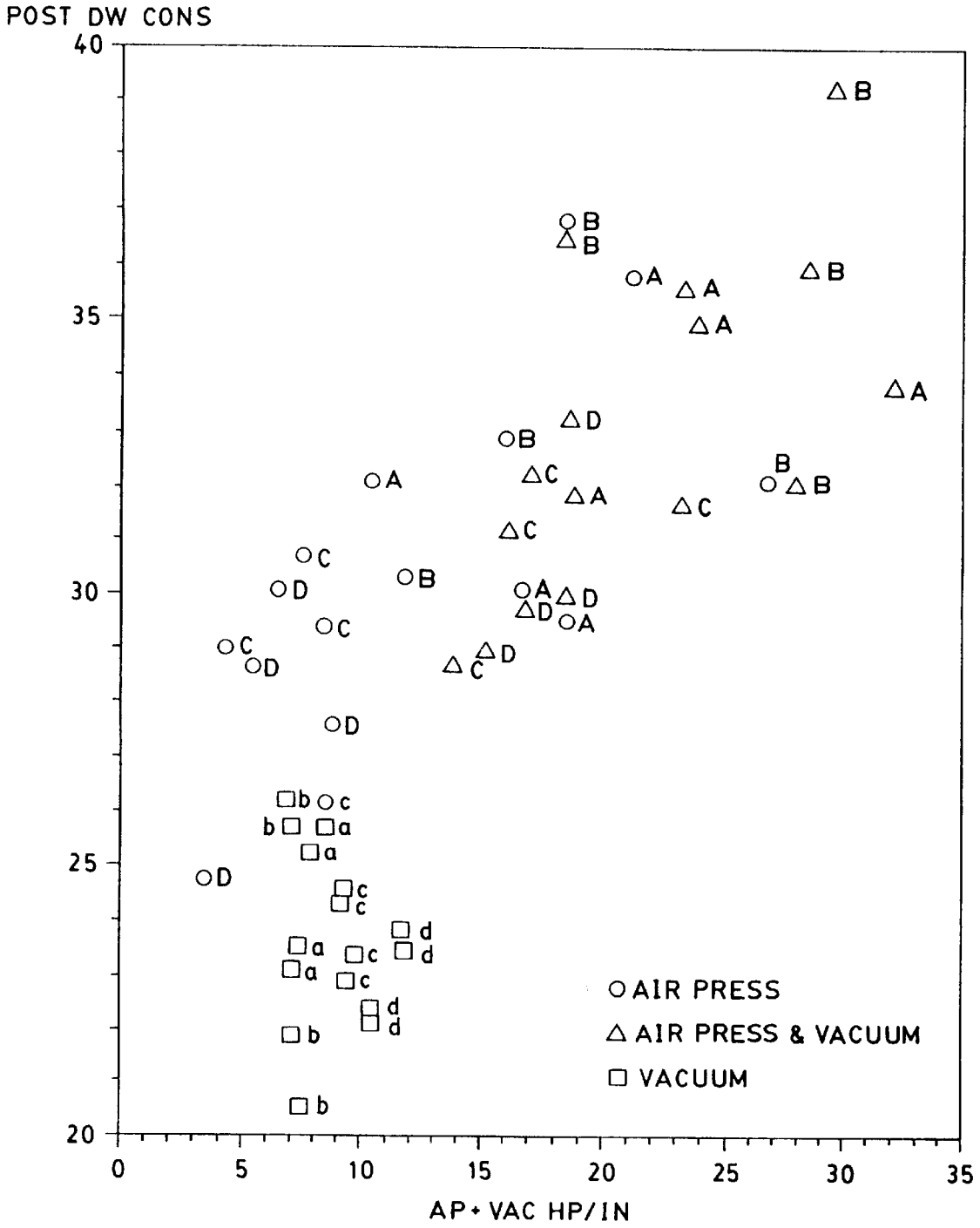
FIG. 13 representatively shows a graph of total energy versus post dewatering consistency for the data from Examples 1 through 8.

FIG. 13 represents an accumulation of the data from FIGS. 9–12. This graph illustrates that that for all furnishes tested, the air press was able to achieve approximately 5–7 percent higher consistency than vacuum dewatering at a comparable energy input. The exact numbers vary from furnish to furnish, but the advantage of the air press compared to vacuum dewatering technology is consistent.

Figure 14:
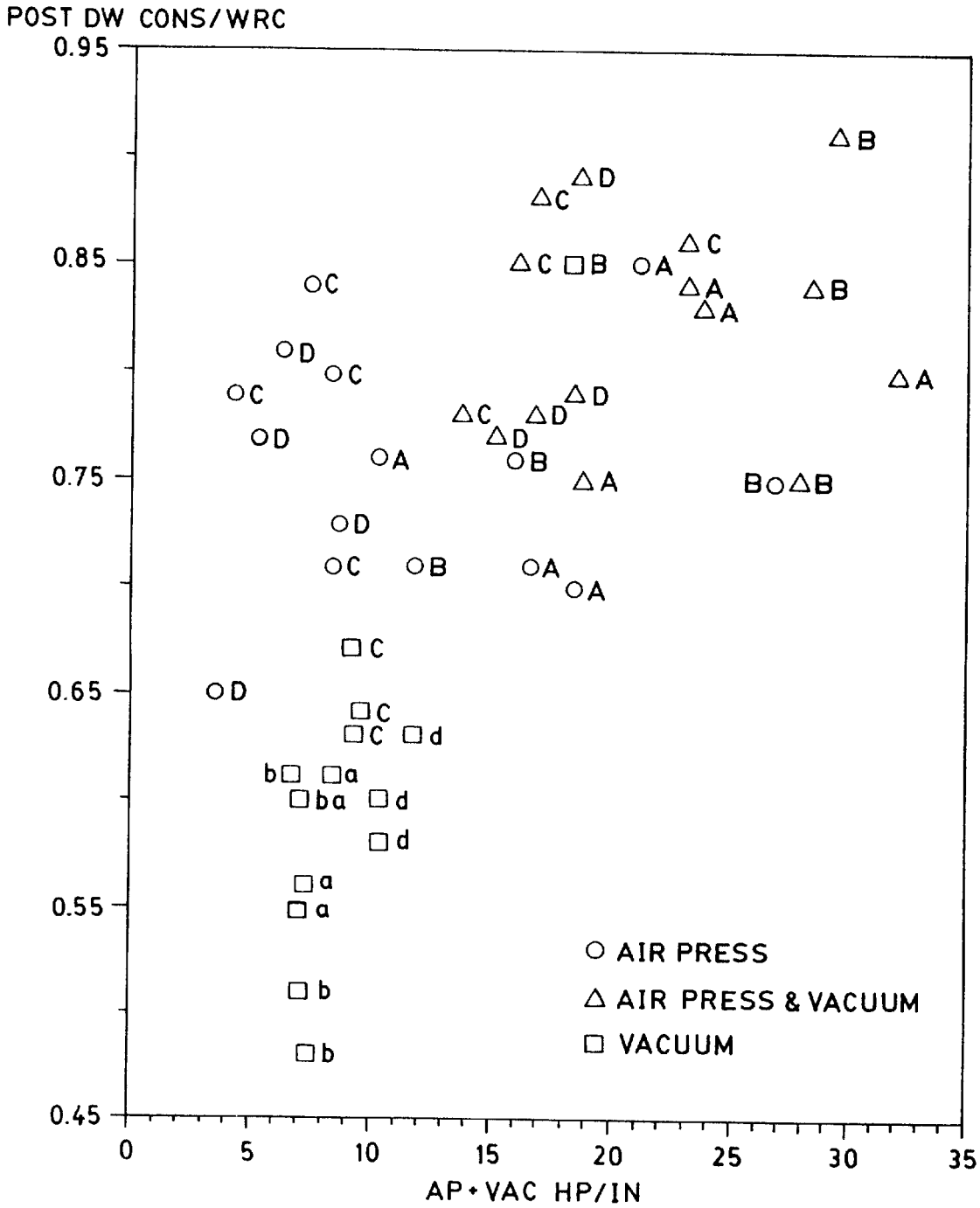
FIG. 14 representatively shows a graph of total energy versus Energy Efficiency for the data from Examples 1 through 8.

From the data of FIGS. 9–13 and the WRV's of the pertinent fibers, FIG. 14 was constructed. Shown in FIG. 14 is the post dewatering stage consistency divided by the WRC versus the total energy/inch expended. In this case, all the vacuum dewatering data merges as does the data for air press dewatering. However, the resulting air press data does not match the vacuum dewatering curve. For a given energy, a significantly higher post dewatering stage consistency divided by WRC is obtained with the air press dewatering than using the conventional vacuum dewatering technology. This difference occurs across all furnish types and basis weights.

To summarize the data of FIGS. 9–14, each furnish has an idiosyncratic response to each dewatering technology. In other words, some furnishes, specifically those with lower WRV's, dewater easier than others. The easy to dewater furnishes give a relatively high consistency for a given energy input. Conversely, those furnishes with high WRV's, give a relatively low consistency for a given energy input. For a given dewatering technology, the consistency/energy relationship can be more closely grouped by dividing the consistency by the WRC. In this case, a single relationship of percent of theoretically achievable dewatering versus energy can be constructed for a given dewatering technology. When a different dewatering technology, say air press dewatering, is utilized, a similar but different consistency/energy relationship exists and a different consistency/WRC versus energy grouping can be constructed that again removes the influence of each furnish. The salient point of this invention is that the consistency/WRC versus energy grouping for air press dewatering is higher than the grouping for conventional vacuum dewatering (prior art) for all furnishes, basis weights, consistencies, and energy inputs.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Further, various alternative process and equipment arrangements may be employed, particularly with respect to the stock preparation, headbox, forming fabrics, web transfers, creping and drying. Therefore, the invention should not be limited by the specific embodiments described, but only by the claims and all equivalents thereto.

What is claimed is:

1. A method for making a cellulosic web, comprising:

a) depositing an aqueous suspension of papermaking fibers onto an endless forming fabric to form a wet web, said papermaking fibers having a water retention consistency and said web having a sheet width; and b) non-compressively dewatering said web from a post forming consistency to a consistency of at least 70 percent of said water retention consistency by passing air through said web and using about 13 or less horsepower per inch of sheet width at a speed of 2500 feet per minute or greater.

2. The method of claim 1, wherein said web is non-compressively dewatered from a post forming consistency to a consistency of at least 70 percent of said water retention consistency using about 13 or less horsepower per inch of sheet width when tested at a speed of 2500 feet per minute.

3. The method of claim 1, wherein said web is non-compressively dewatered from a post forming consistency to a consistency of about 75 percent or greater of said water retention consistency by passing air through said web and using about 13 or less horsepower per inch of sheet width at a speed of 2500 feet per minute or greater.

4. The method of claim 1, wherein said total energy consumption in the step of noncompressively dewatering said web is less than 1000 BTU/pound of water removed.

5. The method of claim 1, wherein the air passing through said web has a temperature of less than about 300 degrees Fahrenheit.

6. The method of claim 5, wherein the air passing through said web has a temperature of less than about 150 degrees Fahrenheit.

7. The method of claim 1, wherein said web has a basis weight of about 100 grams per square meter or less.

8. The method of claim 1, wherein said post forming consistency is from between about 9 to about 13 percent.

9. The method of claim 1, wherein said non-compressive dewatering of said web is accomplished with an air press, said air press having an air plenum and a vacuum box that are sealed so that substantially all of the air fed to said air press passes through said web.

10. The method of claim 9 wherein said air press operates at a pressure ratio of about 3 or less.

11. The method of claim 9 wherein said air press operates with an air flow of about 100 or more standard cubic feet per minute per square inch of open area.

12. The method of claim 9 wherein said non-compressive dewatering of said web further includes one or more vacuum boxes located upstream of said air press.

13. The method of claim 12 wherein said vacuum boxes operate at less than 15 inches of mercury.

14. A method for making a cellulosic web, comprising:

a) depositing an aqueous suspension of papermaking fibers onto an endless forming fabric to form a wet web, said papermaking fibers having a water retention consistency and said web having a sheet width; and b) non-compressively dewatering said web from a post forming consistency to a consistency of at least 80 percent of said water retention consistency by passing air through said web and using about 30 or less horsepower per inch of sheet width at a speed of 2500 feet per minute or greater.

15. The method of claim 14, wherein said web is non-compressively dewatered from a post forming consistency to a consistency of at least 80 percent of said water retention consistency by passing air through said web and using about 25 or less horsepower per inch of sheet width at a speed of 2500 feet per minute or greater.

16. The method of claim 14, wherein said web is non-compressively dewatered from a post forming consistency to a consistency of at least 80 percent of said water retention consistency by passing air through said web and using about 15 or less horsepower per inch of sheet width at a speed of 2500 feet per minute or greater.

17. The method of claim 14, wherein said total energy consumption in the step of noncompressively dewatering said web is less than 1000 BTU/pound of water removed.

18. The method of claim 14, wherein the air passing through said web has a temperature of less than about 300 degrees Fahrenheit.

19. The method of claim 14, wherein said web has a basis weight of about 100 grams per square meter or less.

20. The method of claim 14, wherein said post forming consistency is from between about 9 to about 13 percent.

21. The method of claim 14, wherein said non-compressive dewatering of said web is accomplished with an air press, said air press having an air plenum and a vacuum box that are sealed so that substantially all of the air fed to said air press passes through said web.

22. A method for making a cellulosic web, comprising:

a) depositing an aqueous suspension of papermaking fibers onto an endless forming fabric to form a wet web, said papermaking fibers having a water retention consistency and said web having a sheet width; and b) non-compressively dewatering said web from a post forming consistency to a web consistency of 30 percent or greater by passing air through said web and using about 13 or less horsepower per inch of sheet width at a speed of 2500 feet per minute or greater.

23. A method for making a cellulosic web, comprising:

a) depositing an aqueous suspension of papermaking fibers onto an endless forming fabric to form a wet web, said papermaking fibers having a water retention consistency and said web having a sheet width; and b) non-compressively dewatering said web from a post forming consistency to a web consistency of 33 percent or greater by passing air through said web and using about 13 or less horsepower per inch of sheet width at a speed of 2500 feet per minute or greater.

24. A method for making a cellulosic web, comprising:

a) depositing an aqueous suspension of papermaking fibers onto an endless forming fabric to form a wet web, said papermaking fibers having a water retention consistency and said web having a sheet width; and b) non-compressively dewatering said web from a post forming consistency to a web consistency of 35 percent or greater by passing air through said web and using about 13 or less horsepower per inch of sheet width at a speed of 2500 feet per minute or greater.

25. A method for making a cellulosic web, comprising:

a) depositing an aqueous suspension of papermaking fibers onto an endless forming fabric to form a wet web, said papermaking fibers having a water retention consistency and said web having a sheet width; and b) non-compressively dewatering said web from a post forming consistency to a web consistency of 39 percent or greater by passing air through said web and using about 13 or less horsepower per inch of sheet width at a speed of 2500 feet per minute or greater.

* * * * *